US010542805B2

(12) United States Patent
Scicluna

(10) Patent No.: US 10,542,805 B2
(45) Date of Patent: Jan. 28, 2020

(54) MODULAR SUITCASE FRAME

(71) Applicant: TUMI, INC., Edison, NJ (US)

(72) Inventor: Paul V. Scicluna, Penndel, PA (US)

(73) Assignee: TUMI, INC., Edison, NJ (US)

( * ) Notice: Subject to any disclaimer, the term of this patent is extended or adjusted under 35 U.S.C. 154(b) by 22 days.

(21) Appl. No.: 15/196,673

(22) Filed: Jun. 29, 2016

(65) Prior Publication Data

US 2017/0000232 A1 Jan. 5, 2017

Related U.S. Application Data

(60) Provisional application No. 62/323,943, filed on Apr. 18, 2016, provisional application No. 62/186,822, filed on Jun. 30, 2015.

(51) Int. Cl.

| | |
|---|---|
| ***A45C 13/04*** | (2006.01) |
| ***A45C 13/00*** | (2006.01) |
| ***A45C 5/03*** | (2006.01) |
| ***A45C 13/36*** | (2006.01) |
| ***A45C 5/14*** | (2006.01) |

(52) U.S. Cl.

CPC ..... *A45C 13/04* (2013.01); *A45C 5/03* (2013.01); *A45C 5/14* (2013.01); *A45C 13/005* (2013.01); *A45C 13/36* (2013.01); *A45C 2005/035* (2013.01); *A45C 2005/037* (2013.01)

(58) Field of Classification Search

CPC .. A45C 13/04; A45C 5/03; A45C 5/14; A45C 13/005; A45C 13/36; A45C 2005/035; A45C 2005/037

See application file for complete search history.

(56) References Cited

U.S. PATENT DOCUMENTS

| | | | | | |
|---|---|---|---|---|---|
| 10,334 | A | * | 12/1853 | Cantel | A45C 5/02 16/250 |
| 2,309,029 | A | * | 1/1943 | Wheary, Jr. | A45C 3/001 190/115 |
| 3,044,656 | A | * | 7/1962 | Dobbie | B65D 88/12 217/69 |
| 3,204,905 | A | * | 9/1965 | Marban | F16B 12/46 248/188 |
| 3,962,010 | A | * | 6/1976 | Riou | A45C 5/02 156/93 |
| 4,744,445 | A | * | 5/1988 | Anderson | A45C 5/02 190/107 |

(Continued)

FOREIGN PATENT DOCUMENTS

| | | |
|---|---|---|
| CN | 2069674 U | 1/1991 |
| CN | 203633635 U | 6/2014 |

(Continued)

OTHER PUBLICATIONS

International Search Report and the Written Opinion of the International Searching Authority from corresponding PCT/US2016/040207 dated Oct. 4, 2016.

(Continued)

*Primary Examiner* — Tri M Mai

(74) *Attorney, Agent, or Firm* — Lando & Anastasi, LLP

(57) ABSTRACT

A piece of luggage comprises a front shell, a rear shell, and a frame assembly configured to hingedly secure the front shell to the rear shell. The frame assembly including a front frame sub-assembly configured to be secured to the front shell and a rear frame sub-assembly configured to be secured to the rear shell. Each of the front frame sub-assembly and the rear frame sub-assembly including a plurality of frame members and a plurality of corner members.

19 Claims, 17 Drawing Sheets

(56) References Cited

U.S. PATENT DOCUMENTS

| | | | | |
|---|---|---|---|---|
| 5,115,895 | A | 5/1992 | Myers | |
| 6,050,373 | A * | 4/2000 | Wonka | A45C 5/03 190/103 |
| 6,604,617 | B2 | 8/2003 | Davis et al. | |
| 6,936,127 | B2 | 8/2005 | Fenton et al. | |
| 8,752,683 | B2 | 6/2014 | Scicluna | |
| 9,089,964 | B2 * | 7/2015 | Cheng | B25H 3/02 |
| 2008/0131197 | A1 * | 6/2008 | Hamlen | B65D 7/44 403/231 |
| 2012/0012596 | A1 * | 1/2012 | Hollebone | A45C 13/36 220/694 |
| 2013/0140252 | A1 * | 6/2013 | Murakami | H05K 7/18 211/26 |
| 2014/0311844 | A1 | 10/2014 | Meersschaert et al. | |
| 2015/0129384 | A1 | 5/2015 | Mertens et al. | |

FOREIGN PATENT DOCUMENTS

| | | | |
|---|---|---|---|
| EP | 2826394 | A1 | 1/2015 |
| GB | 2094878 | A | 9/1982 |
| WO | 2010029581 | A1 | 3/2010 |
| WO | 2013072086 | A1 | 5/2013 |

OTHER PUBLICATIONS

Extended European Search Report from European Application No. 16818730.0 dated Feb. 5, 2019.
Office Action from Chinese Application No. 201680039294.6 dated Dec. 25, 2018.

* cited by examiner

MODULAR SUITCASE FRAME

RELATED APPLICATIONS

This application claims priority to U.S. Provisional Patent Application Ser. No. 62/186,822 filed on Jun. 30, 2015 entitled Modular Suitcase Frame, the disclosures of which are incorporated herein by reference. This application also claims priority to U.S. Provisional Patent Application Ser. No. 62/323,943 filed on Apr. 18, 2016 entitled Modular Suitcase Frame, the disclosures of which are incorporated herein by reference.

FIELD OF THE INVENTION

This disclosure relates to a modular, high strength suitcase frame for piece of luggage and for a method for the manufacture thereof.

BACKGROUND

Luggage may typically be divided into two categories—soft luggage, and hard shell luggage. Soft luggage is typically wrapped in a soft material, such as cloth, canvas, leather, fabric, and/or vinyl. Soft luggage is typically constructed by forming an internal frame from metal and plastic materials which may be fastened together to define an interior compartment for storing items. Padding may then be applied to the exterior and interior of the plastic and metal frame, before a soft, cloth material is applied to the exterior and interior of the luggage by stitching and/or adhering it to the luggage frame and cushioning. Soft luggage is an attractive choice for luggage designers because it allows the designer to create more intricate details and aesthetic features in the soft, cloth material, which is easily cut, stitched, and arranged to create visually appealing luggage designs. However, soft luggage is typically less durable than hard shell luggage and is subject to tearing, ripping, and staining during the normal life of the luggage.

Hard shell luggage on the other hand is formed of a hard plastic material such as polyvinyl chloride (PVC), polyethylene (PE), polypropylene (PP), carbon fiber, or Tegris®. Hard shell luggage has the advantage of resisting deformation by external forces, which affords greater protection to the contents against damage as well as preserving the overall shape and appearance of the luggage. However, hard shell luggage can be heavier than soft luggage, and designers tend to have fewer options for altering the aesthetic appearance of hard shell luggage, given the typical methods of manufacturing hard shell luggage.

Hard shell luggage also typically requires a more complex manufacturing process, such as injection molding or vacuum forming. These processes include the use of expensive and complex molding equipment, multiple heating and cooling steps, trimming steps, and cleaning steps to produce the luggage body. Once the front and rear hard shell components of the luggage are formed they are typically adhered to a metal frame that is placed on the center-facing edge of the hard shells. Locks, hinges, and other hardware may then be connected to this metal frame. Liners and other internal components may also then be installed. This manufacturing process can be expensive and time consuming as compared to manufacturing processes for soft bags.

Items of luggage that attempt to combine certain features of hard and soft bags are described in U.S. Pat. No. 6,936,127 to Fenton et al. and U.S. Pat. No. 6,604,617 to Davis et al., the disclosures of which are incorporated in their entirety by reference herein. U.S. Pat. No. 8,752,683 to Scicluna also teaches a relatively simple and inexpensive manufacturing technique for forming hard shell luggage, the disclosures of which is incorporated in its entirety by reference herein. Nevertheless, there remains a need for a modular suitcase frame, the components of which may be mass produced with relatively simple and inexpensive manufacturing techniques and which components may then be adapted for various suitcase designs and assembled with less cost and labor than currently available techniques for manufacturing hard shell luggage.

SUMMARY OF THE INVENTION

In one example, a method for producing an article of luggage may be provided, including the steps of forming a plurality of hard luggage shells comprising one or more front hard shells and one or more rear hard shells having substantially similar widths and heights, forming a length of front edge framing material having a tab portion and a front edge coupling portion that extends along the length of the front edge framing material, forming a length of rear edge framing material, having a tab portion and a rear edge coupling portion that extends along the length of the rear edge framing material wherein said front edge coupling portion and said rear edge coupling portion are capable of matingly coupling, cutting said front edge framing material and said rear edge framing material into two or more pieces having a length that is substantially similar to the width of said hard luggage shells and into two or more pieces having a length that is substantially similar to the height of said hard luggage shells, forming a plurality of reinforcing corner pieces, forming a plurality of front edge joint pieces, forming a plurality of rear edge joint pieces, constructing a front edge frame comprising at least four pieces of front edge framing material, at least eight front edge joint pieces, and at least four reinforcing corner pieces, constructing a rear edge frame comprising at least four pieces of rear edge framing material, at least eight rear edge joint pieces, and at least four reinforcing corner pieces, attaching said front edge frame to said front hard shell, attaching said rear edge frame to said rear hard shell, and attaching said front hard shell to said rear hard shell with a hinge. In some examples, the front edge framing material and the rear edge framing material may be formed by passing a length of metal reinforcement material through a hard plastic extruder, thereby embedding a length of metal reinforcement material throughout the length of the front edge framing material and the rear edge framing material. In other examples the step of forming a plurality of reinforcing corner pieces may further comprise forming a plurality of exterior reinforcing corner pieces and forming a plurality of interior reinforcing corner pieces. In some examples, front exterior reinforcing corner pieces may matingly couple with rear exterior reinforcement corner pieces. In some examples, the method further includes forming front inter reinforcing corner pieces and rear interior reinforcing corner pieces, which may be capable of matingly coupling with each other.

In another example, a piece of hard shell luggage may be provided that comprises at least two hard luggage shells comprising one or more front hard shells and one or more rear hard shells having substantially similar widths and heights, at least four pieces of front edge framing material having a tab portion and a front edge coupling portion that extends along the length of said front edge framing material, at least four pieces of rear edge framing material, having a tab portion and a rear edge coupling portion that extends along the length of the front edge framing material wherein said front edge coupling portion and said rear edge coupling portion are capable of matingly coupling, at least eight reinforcing corner pieces, at least eight front edge joint pieces, at least eight rear edge joint pieces, a front edge frame comprising said at least four pieces of front edge framing material, said at least eight front edge joint pieces, and said at least four reinforcing corner pieces, a rear edge frame comprising said at least four pieces of rear edge framing material, said at least eight rear edge joint pieces, and said at least four reinforcing corner pieces, wherein said front edge frame is attached to said front hard shell and said rear edge frame is attached to said rear hard shell, and a hinge. In some examples, the piece of luggage further comprises at least four front external reinforcing corner pieces, at least four front internal reinforcing corner pieces, at least four rear external reinforcing corner pieces, and at least four rear internal reinforcing corner pieces, wherein the at least four front external reinforcing corner pieces matingly couple with the at least four rear external reinforcing corner pieces and the at least four front internal reinforcing corner pieces matingly couples with the at least four rear internal reinforcing corner pieces. In some examples, the front edge frame is attached to the front hard shell along the tab portion of the front edge framing material and the rear edge frame is attached to the rear hard shell along the tab portion of the rear edge framing material.

In other examples of the present disclosure a method for producing an article of luggage is provided for, including the steps of forming a plurality of luggage shells comprising a front shell and a rear shell having substantially similar widths and heights, forming a length of edge framing material having a tab portion and an edge coupling portion that extends along the length of the edge framing material, cutting the edge framing material into two or more pieces having a length that is substantially similar to the width of the front and rear luggage shells and into two or more pieces having a length that is substantially similar to the height of the front and rear luggage shells, forming a plurality of reinforcing corner pieces, forming a plurality of front edge joint pieces, forming a plurality of rear edge joint pieces, constructing a front edge frame comprising at least four pieces of front edge framing material, at least eight front edge joint pieces, and at least four reinforcing corner pieces, constructing a rear edge frame comprising at least four pieces of rear edge framing material, at least eight rear edge joint pieces, and at least four reinforcing corner pieces, attaching the front edge frame to the front shell, attaching the rear edge frame to the rear shell, and attaching the front shell to the rear shell with a hinge.

In some examples, the method may further include forming the front edge framing material and the rear edge framing material are done by passing a length of metal reinforcement material through a hard plastic extruder, thereby embedding a length of metal reinforcement material throughout the length of the front edge framing material and the rear edge framing material. Other examples include forming a plurality of reinforcing corner pieces further comprises forming a plurality of exterior reinforcing corner pieces and forming a plurality of interior reinforcing corner pieces. In some implementations, forming a plurality of exterior reinforcing corner pieces further comprises forming front exterior reinforcing corner pieces and rear exterior reinforcing corner pieces. The front exterior reinforcing corner pieces may be formed so as to matingly couple with the rear exterior reinforcing corner pieces. Forming a plurality of interior reinforcing corner pieces may further include forming front inter reinforcing corner pieces and rear interior reinforcing corner pieces. The front interior reinforcing corner pieces may also formed so as to matingly couple with the rear interior reinforcing corner pieces.

In some examples, at least four of the front exterior reinforcing corner pieces are attached to at least four of the front interior reinforcing corner pieces. In other examples, at least four of the rear exterior reinforcing corner pieces are attached to at least four of the rear interior reinforcing corner pieces. The front edge frame may also be attached to the front shell along the tab portion of the front edge framing material. The rear edge frame may be attached to the rear shell along the tab portion of the rear edge framing material. In some examples, the piece of luggage comprises a piece of hard shell luggage and the front shell and the rear shell comprise hard shells. In other examples, the front shell and the rear shell are soft-sided shells.

In another implementation of the present disclosure, a piece of soft-sided luggage is disclosed that includes a front shell and a rear shell, each shell comprising an internal compartment for receiving contents, at least four pieces of front edge framing material having a tab portion and a front edge coupling portion that extends along the length of the front edge framing material, at least four pieces of rear edge framing material having a tab portion and a rear edge coupling portion that extends along the length of the rear edge framing material, wherein the front edge coupling portion and the rear edge coupling portion are capable of matingly coupling, at least eight reinforcing corner pieces, at least eight front edge joint pieces, at least eight rear edge joint pieces, a front edge frame comprising the at least four pieces of front edge framing material, at least eight front edge joint pieces, and the at least four reinforcing corner pieces, a rear edge frame comprising the at least four pieces of rear edge framing material, at least eight rear edge joint pieces, and the at least four reinforcing corner pieces, wherein the front edge frame is attached to the front shell and the rear edge frame is attached to the rear shell, and a hinge joining the front edge frame to the rear edge frame.

In some examples of the piece of luggage, the at least eight corner pieces further comprises at least four front external reinforcing corner pieces, at least four front internal reinforcing corner pieces, at least four rear external reinforcing corner pieces, and at least four rear internal reinforcing corner pieces. The at least four front external reinforcing corner pieces may also matingly couple with the at least four rear external reinforcing corner pieces and the at least four front internal reinforcing corner pieces matingly couples with the at least four rear internal reinforcing corner pieces. In other examples, the front edge frame is attached to the front shell along the tab portion of the front edge framing material and the rear edge frame is attached to the rear shell along the tab portion of the rear edge framing material. The piece of luggage may also include a latch or a lock attached to one or more of the front or rear shells. In some examples, front shell and rear shell comprise hard shells. In other examples, the front shell and the rear shell are soft-sided shells.

In another implementation of the present disclosure, a method for producing an article of luggage is provided that includes the steps of forming a plurality of luggage shells comprising a front shell and a rear shell having substantially similar widths and heights, forming a length of edge framing material having a tab portion and an edge coupling portion that extends along the length of the edge framing material, cutting the edge framing material into two or more pieces having a length that is substantially similar to the width of the front and rear luggage shells and into two or more pieces having a length that is substantially similar to the height of the front and rear luggage shells, forming a plurality of reinforcing corner pieces, forming a plurality of front edge joint pieces, forming a plurality of rear edge joint pieces, constructing a front edge frame comprising at least four pieces of front edge framing material, at least eight front edge joint pieces, and at least four reinforcing corner pieces, constructing a rear edge frame comprising at least four pieces of rear edge framing material, at least eight rear edge joint pieces, and at least four reinforcing corner pieces, attaching the front edge frame to the front shell attaching the rear edge frame to the rear shell, and joining the front shell to the rear shell with a hinge.

In some examples, the step of forming the front edge framing material and the rear edge framing material are done by passing a length of metal reinforcement material through a hard plastic extruder, thereby embedding a length of metal reinforcement material throughout the length of the front edge framing material and the rear edge framing material. In other examples, the step of forming a plurality of reinforcing corner pieces further comprises forming a plurality of exterior reinforcing corner pieces and forming a plurality of interior reinforcing corner pieces. Forming a plurality of exterior reinforcing corner pieces may also include forming front exterior reinforcing corner pieces and rear exterior reinforcing corner pieces. In some examples, the front exterior reinforcing corner pieces are formed so as to matingly couple with the rear exterior reinforcing corner pieces. In other examples, forming a plurality of interior reinforcing corner pieces further comprises forming front inter reinforcing corner pieces and rear interior reinforcing corner pieces.

In other examples of the method, the front interior reinforcing corner pieces are formed so as to matingly couple with the rear interior reinforcing corner pieces. In such examples, at least four of the front exterior reinforcing corner pieces may be attached to at least four of the front interior reinforcing corner pieces. In other examples, at least four of the rear exterior reinforcing corner pieces are attached to at least four of the rear interior reinforcing corner pieces. The front edge frame may also attached to the front shell along the tab portion of the front edge framing material. The rear edge frame may also be attached to the rear shell along the tab portion of the rear edge framing material. In some examples, the article of luggage produced by the method comprises a hard shell luggage and the front shell and the rear shell comprise hard shells. In other examples, the piece of luggage comprises a soft shell luggage and the front shell and the rear shell are soft-sided shells. In other examples, the step of joining the front shell to the rear shell is done by attaching the at least one hinge is to the front shell and to the rear shell with the at least one hinge. Joining the front shell to the rear shell may also be done by attaching the front edge frame and the rear edge frame with the at least one hinge.

In another example of the present disclosure, a piece of luggage may be provided for, comprising a front shell and a rear shell, each shell comprising an internal compartment for receiving contents, at least four pieces of front edge framing material having a tab portion and a front edge coupling portion that extends along the length of the front edge framing material, at least four pieces of rear edge framing material having a tab portion and a rear edge coupling portion that extends along the length of the rear edge framing material, wherein the front edge coupling portion and the rear edge coupling portion are capable of matingly coupling, at least eight reinforcing corner pieces, at least eight front edge joint pieces, at least eight rear edge joint pieces, a front edge frame comprising the at least four pieces of front edge framing material, at least eight front edge joint pieces, and the at least four reinforcing corner pieces, a rear edge frame comprising the at least four pieces of rear edge framing material, at least eight rear edge joint pieces, and the at least four reinforcing corner pieces, wherein the front edge frame is attached to the front shell and the rear edge frame is attached to the rear shell, and at least one hinge joining the front shell to the rear shell.

In some examples, at least eight corner pieces further comprises at least four front external reinforcing corner pieces, at least four front internal reinforcing corner pieces, at least four rear external reinforcing corner pieces, and at least four rear internal reinforcing corner pieces. In other examples, the at least four front external reinforcing corner pieces matingly couples with the at least four rear external reinforcing corner pieces and the at least four front internal reinforcing corner pieces matingly couples with the at least four rear internal reinforcing corner pieces. The front edge frame may also be attached to the front shell along the tab portion of the front edge framing material and the rear edge frame is attached to the rear shell along the tab portion of the rear edge framing material. The piece of luggage may also include a latch or a lock attached to one or more of the front or rear shells. The front shell and the rear shell may comprise hard shells or soft-sided shells. The at least one hinge may also be attached to the front shell and to the rear shell.

BRIEF DESCRIPTION OF THE DRAWINGS

Various aspects of at least one example are discussed below with reference to the accompanying figures. Where technical features in the figures or detailed description are followed by reference signs, the reference signs have been included for the sole purpose of increasing the intelligibility of the figures or detailed description. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the disclosure. In the figures:

LIST OF REFERENCE NUMERALS UTILIZED IN THE DRAWINGS

Figure 1A:
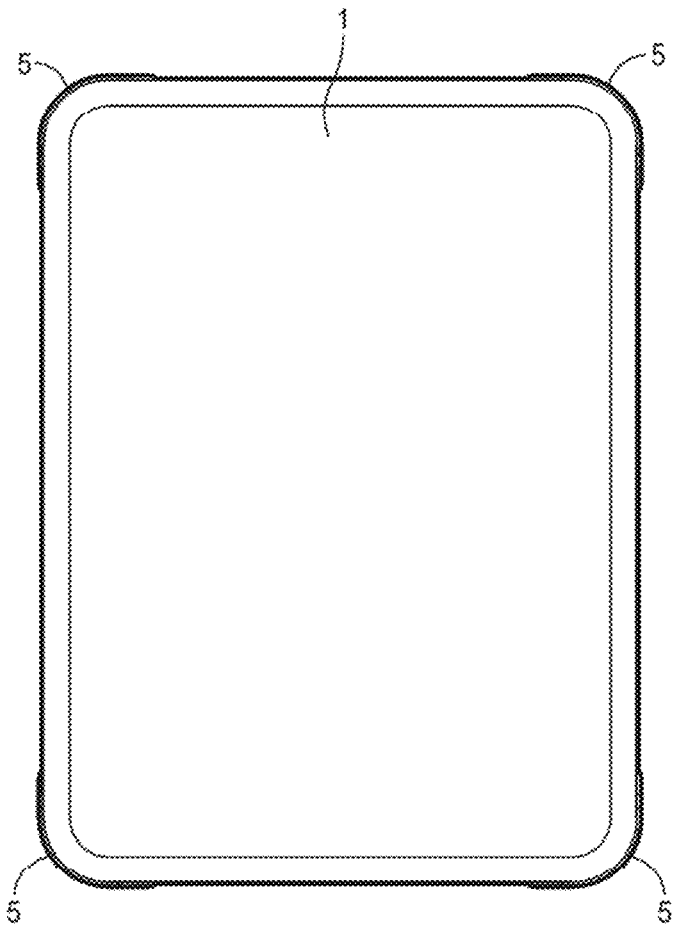
FIG. 1A is a front view of a modular suitcase in one example of the present disclosure.

Reference numeral 1 refers to a front hard shell;
Reference numeral 2 refers to a rear hard shell;
Reference numeral 3 refers to a front frame member;
Reference numeral 4 refers to a rear frame member;
Reference numeral 5 refers to a front corner member;
Reference numeral 6 refers to a rear corner member;
Reference numeral 7 refers to a front bar portion;
Reference numeral 8 refers to a front end joint;
Reference numeral 9 refers to two or more recessed portions on the front internal corner member;
Reference numeral 10 refers to one or more openings in the front end joint;
Reference numeral 11 refers to one or more projections in the front end joint;
Reference numeral 12 refers to a front internal corner member;
Reference numeral 13 refers to a projection on the front corner member;
Reference numeral 14 refers to a opening in the projection on the front corner member;
Reference numeral 15 refers to two or more openings on the front internal corner member;
Reference numeral 16 refers to a rear bar portion;
Reference numeral 17 refers to a rear end joint;
Reference numeral 18 refers to two or more recessed portions on the rear internal corner member;
Reference numeral 19 refers to one or more openings in the rear end joint;
Reference numeral 20 refers to one or more projections in the rear end joint;
Reference numeral 21 refers to a rear internal corner member;
Reference numeral 22 refers to a projection on the rear corner member;
Reference numeral 23 refers to an opening in the projection on the rear corner member;
Reference numeral 24 refers to two or more openings on the rear internal corner member;
Reference numeral 25 refers to a length of metal reinforcement within the front and/or rear frame members;
Reference numeral 26 refers to a hinge;
Reference numeral 27 refers to a front leaf of a hinge;
Reference numeral 28 refers to a rear leaf of a hinge;
Reference numeral 29 refers to one or more cylindrical projections on a hinge;
Reference numeral 30 refers to a pin for a hinge;
Reference numeral 31 refers to an o-ring for retaining a pin on a hinge;
Reference numeral 32 refers to feet on the underside of a hinge;
Reference numeral 33 refers to a latch;
Reference numeral 34 refers to a catch portion of a latch;
Reference numeral 35 refers to a lever portion of a latch;
Reference numeral 36 refers to a spring-loaded hinged arm on the lever portion of a latch;
Reference numeral 37 refers to one or more eyelets on the lever portion of a latch;
Reference numeral 38 refers to one or more recessed slots on the catch portion of a latch;
Reference numeral 40 refers to a button for releasing a spring-loaded lock on a latch;
Reference numeral 41 refers to one or more feet on the underside of a latch;
Reference numeral 42 refers to the wheels of a combination lock on a latch;
Reference numeral 43 refers to a front side of a soft-sided luggage item; and
Reference number 45 refers to a rear side of a soft-sided luggage item.

DETAILED DESCRIPTION

Reference will now be made in detail to representative examples illustrated in the accompanying drawings. It should be understood that the following descriptions are not intended to limit the examples to one preferred implementation of the disclosure. To the contrary, it is intended to cover alternatives, modifications, and equivalents as may be included within the spirit and scope of the described examples as defined by the appended claims.

Figure 1B:
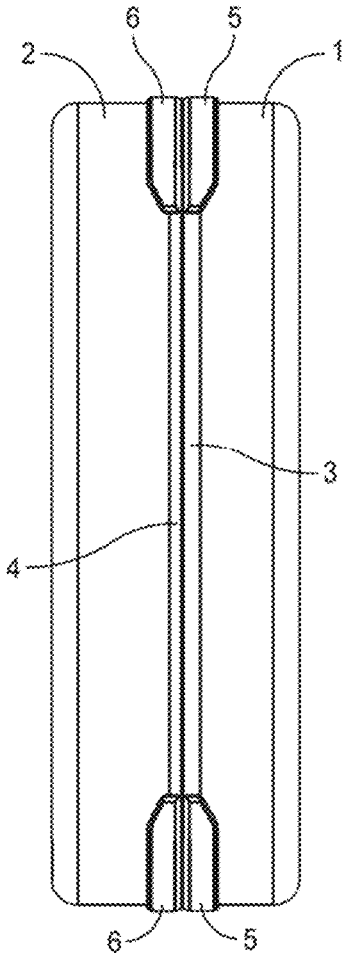
FIG. 1B is a side view of a modular suitcase in one example of the present disclosure.

FIGS. 1A and 1B shows a fully constructed modular suitcase according to one example of the present disclosure. FIG. 1A shows a front or rear view of the modular suitcase and FIG. 1B shows a side view of the modular suitcase. In general, the modular suitcase may include a concave front hard shell 1 and a concave rear hard shell 2. Front hard shell 1 and rear hard shell 2 may be formed of a hard plastic material such as polyvinyl chloride (PVC), polyethylene (PE), polypropylene (PP), carbon fiber, or Tegris® polypropylene moldable fabric manufactured by Milliken (available at http://www.milliken.com/MFT). However, a person having ordinary skill in the art will recognize that any suitable fabric, plastic, metal, or any other suitable material having a high stiffness-to-weight ratio and high impact resistance may be used. Front hard shell 1 and rear hard shell 2 may also be formed by any suitable means for forming hard shells for luggage, including thermoforming a sheet of hard plastic material onto a mold for the luggage shell, vacuum forming, compression molding, injection molding, or blow molding.

In a preferred example, front hard shell 1 and rear hard shell 2 may be formed of material that includes a woven polypropylene thermoplastic composite having a plurality of layers, such as Tegris® polypropylene moldable fabric. For example, the front hard shell 1 and rear hard shell 2 may include six layers of the woven polypropylene thermoplastic composite, or any other suitable number of layers. In some examples, front hard shell 1 and rear hard shell 2 may be coated with a surface coating, and the surface coating can be, for example, a polyester film, or any other suitable material. In some examples, front hard shell 1 and rear hard shell 2 may be formed according to the processes described in U.S. Pat. No. 8,752,683 to Scicluna, which describes a method of manufacturing a hard shell for luggage in which a series of notches are cut out of a sheet of stiff shell material that is then folded to define front, top, bottom, left side, and right side faces of the luggage before various fasteners and corner pieces are attached to hold the shell together.

Front hard shell 1 and rear hard shell 2 may also be constructed with any desired dimensions so long as the dimensions of front hard shell 1 and rear hard shell 2 match or substantially match, such that front hard shell 1 and rear hard shell 2 may join to form a single piece of hard shell luggage, as shown for example in FIGS. 1A and 1B. No particular dimensions are required as it is an object of the present disclosure to provide an easily adaptable manufacturing process for hard shell luggage of differing dimensions and sizes using a single set of components that are easily adapted for hard shell luggage of varying sizes and dimensions. However, in some examples, the depth of front hard shell 1 may be less than that of rear hard shell 2. In other examples, the dimensions of front hard shell 1 may be identical or substantially identical to those of rear hard shell 2.

As further shown in FIG. 1B, front hard shell 1 and rear hard shell 2 may be joined by connecting one or more of front frame member 3 to the open edge of front hard shell 1 and one or more of rear frame member 4 to the open edge of rear hard shell 2. One or more of front corner member 5 may also be attached to the corners of the open edge of hard shell 1, while one or more of rear corner member 6 may be attached to the corners of the open edge of rear hard shell 2. Once front frame members 3, rear frame members 4, front corner members 5, and rear corner members 6 have been attached to front hard shell 1 and rear hard shell 2, the open faces of front hard shell 1 and rear hard shell 2 may be closed, defining an internal luggage compartment.

Figure 2:
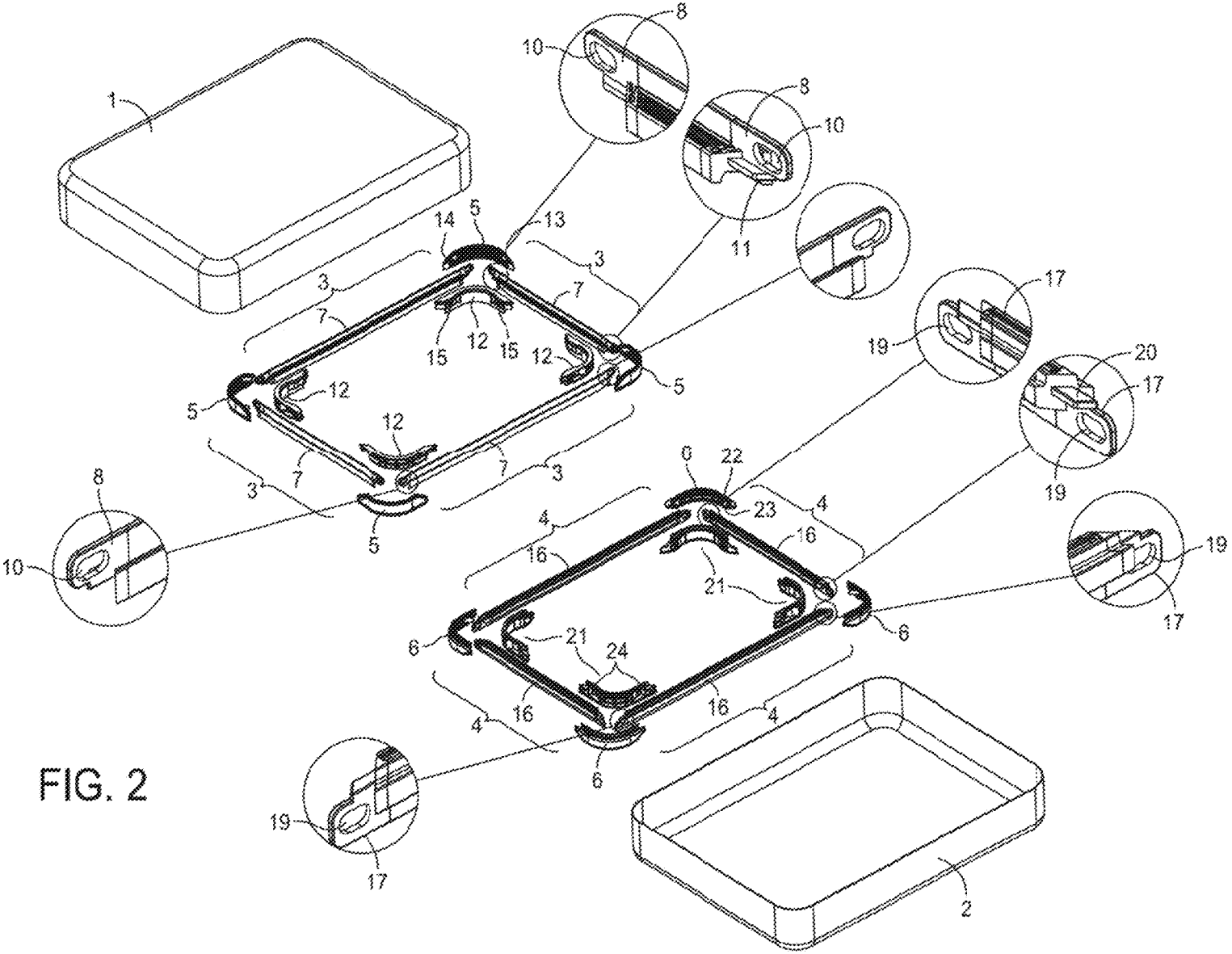
FIG. 2 is an exploded perspective view of an example of a modular suitcase of the present disclosure, with details of the modular suitcase enlarged.

FIG. 2 shows an exploded view of the modular components of the hard shell suitcase. As shown, for example, in FIG. 2, each front frame member 3 includes a front bar portion 7 that is connected to a front end joint 8. Front bar portion 7 may include a bar having both a vertical lip for attaching front bar portion 7 to the interior or exterior walls of front hard shell 1 and a horizontal engagement portion which serves to both abut the open edge of front hard shell 1 on the top side of the horizontal portion and engage with a corresponding rear frame member 4 on its bottom side. As shown, for example in FIG. 3A, the bottom side of the horizontal portion may be either convex or concave or irregularly shaped, so long as it is designed and configured to matingly couple to the top side of the horizontal portion of corresponding rear frame member 4. The vertical lip of front frame member 3 may be attached to the interior or exterior surface of front hard shell 1 using any suitable techniques for attachment known to one of ordinary skill in the art, including gluing, stitching, fastening, screwing, welding, and/or through the use of a locking mechanism.

Figure 3A:
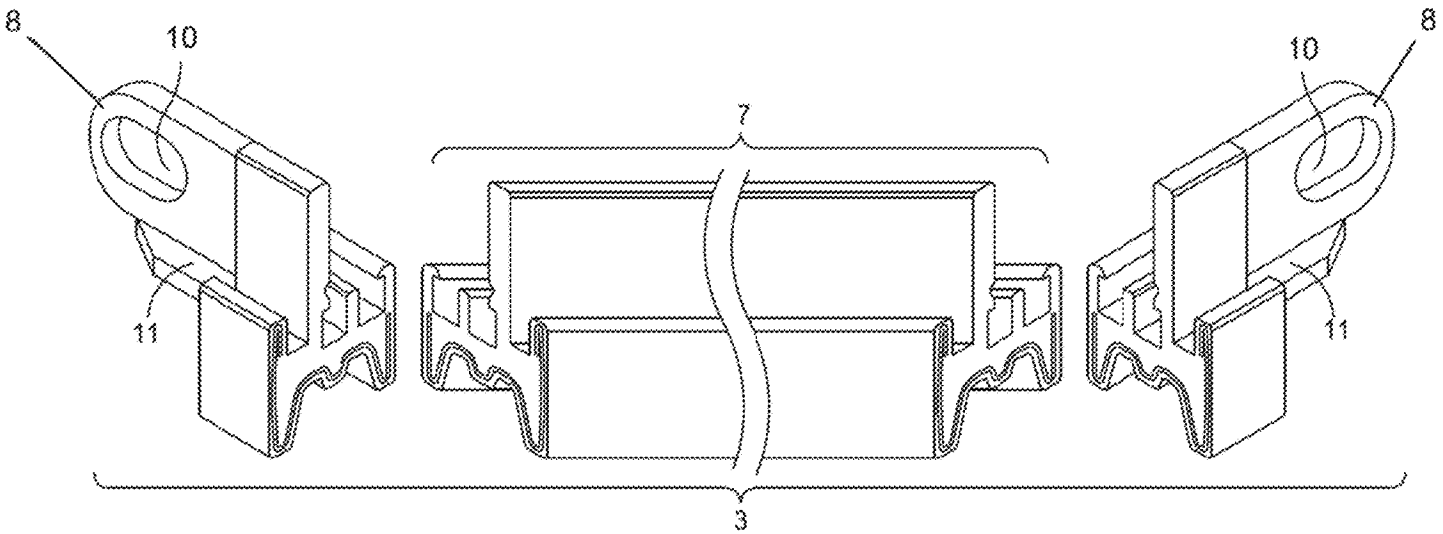
FIG. 3A is a perspective view of an example of a front frame member of a modular suitcase with portions being shown in cross section.

FIG. 3A shows an exploded view of front frame member 3. Each end of front bar portion 7 may be connected to a front end joint 8. As shown in FIG. 2, front end joint 8 may be attached, at its proximal end, to the end of front bar portion 7 using any suitable techniques for attachment known to one of ordinary skill in the art, including gluing, stitching, fastening, screwing, welding, and/or a locking mechanism. At its proximal end, front end joint 8 may have a cross-sectional shape that matches that of front bar portion 7, including a vertical lip for attaching to front hard shell 1, and a horizontal portion for matingly coupling to the top side of the horizontal portion of corresponding rear end joint 17. At its distal end, front end joint 8 may be designed and configured for coupling with front corner member 5. Front end joint 8 may be attached to front corner member 5 using any suitable means for attachment as are known to those of ordinary skill in the art, including gluing, stitching, fastening, screwing, welding, and/or through the use of a locking mechanism. In a preferred example, the distal end of front end joint 8 includes one or more openings 10 along its vertical lip portion through which a screw or bolt, or other fastener may be passed for attaching front end joint 8 to front corner member 5. The distal end of front end joint 8 may also include one or more projections 11 for guiding front end joint 8 into the proper alignment with front corner member 5 and/or front internal corner member 12, as discussed below.

Referring again to FIG. 2, each end of front corner member 5 may connect to two front frame members 3 to achieve a 90-degree angle between the two front frame members 3. Front corner member 5 may be formed of any suitable materials as are known to those of ordinary skill in the art, including wood, metal, or hard plastic, such as PVC or Acrylonitrile Butadiene Styrene (ABS) plastic. Front corner member 5 may take any suitable shape, so long as it is capable of forming a right angle with two front frame members. In a preferred example, front corner 5 is substantially rounded in order to avoid any potentially sharp edges and to provide an attractive appearance. As previously described, front corner member 5 may be attached to front end joint 8 using any suitable means for attachment as are known to those of ordinary skill in the art. However, in a preferred example, front corner member 5 includes two projections 13 for extending through one or more openings 10 in front end joint 8, as shown for example in FIGS. 4A and 4B. Projections 13 include one or more openings 14 for receiving a screw or bolt, or other fastener.

Figure 4B:
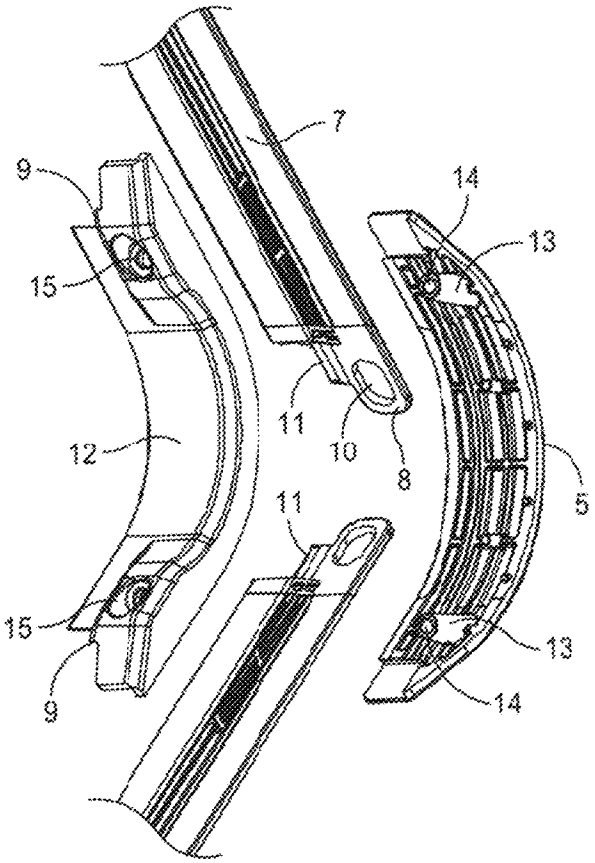
FIG. 4B is an internal perspective view of an intersection between a front corner member, a front internal corner member, and a front frame member of an example of a modular suitcase.
Figure 4A:
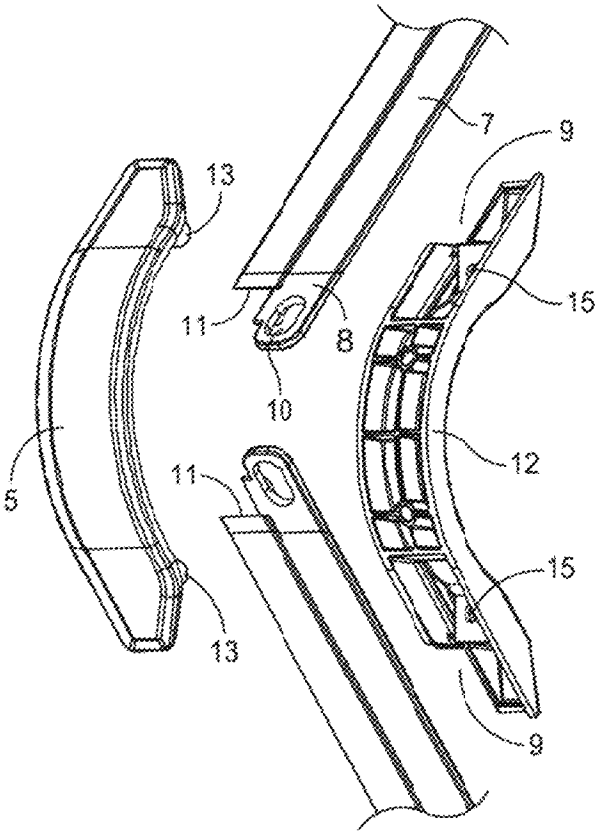
FIG. 4A is an external perspective view of an intersection between a front corner member, a front internal corner member, and a front frame member of an example of a modular suitcase.

FIGS. 4A and 4B show an exploded view of the front corner member 5, the front internal corner member 12, and the front frame member 3 from the external (FIG. 4A) and internal (FIG. 4B) perspectives. In some examples, front corner member 5 and front end joints 8 are also connected to a front internal corner member 12 for additional stability.

Front internal corner member 12 may be constructed of the same materials as front corner member 5, and may be generally shaped to matingly couple to front corner member 5 while substantially enclosing front end joints 8 and, in some examples, a portion of front frame member 3. Front internal corner member 12 may be attached to front end joint 8 and front corner member 5 using any suitable means for attachment as are known to those of ordinary skill in the art. However, in a preferred example, front internal corner member 12 includes two openings 15 for receiving a screw or bolt, or other fastener, which may pass through opening 10 in front end joint 8, and screw into opening 14 in front corner member 5. As shown in FIG. 2, one or more of front corner member 5 and/or front internal corner member 12 may include two or more recessed portions 9 (See FIG. 4B) for receiving projections 11 for guiding front end joint 8 into the proper alignment with front corner member 5 and/or front internal corner member 12.

The frame may be constructed for rear hard shell 2 in a similar manner to the frame described with respect to front hard shell 1, above. As shown, for example, in FIG. 3B, each rear frame member 4 includes a rear bar portion 16 which is connected to a rear end joint 17 at each end. In some examples, rear bar portion 16 includes a generally L-shaped bar that includes both a vertical lip for attaching to the interior or exterior walls of rear hard shell 2 and a horizontal engagement portion which serves to both abut the open edge of rear hard shell 2 on the bottom side and engage with a corresponding front frame member 3 on the top side. The top side of the horizontal portion of rear frame member 4 may be either convex or concave or irregularly shaped, so long as it is designed and configured to matingly couple to the bottom side of the horizontal portion of corresponding front frame member 3. The vertical lip of rear frame member 4 may be attached to the interior or exterior of rear hard shell 2 using any suitable techniques for attachment known to one of ordinary skill in the art, including gluing, stitching, fastening, screwing, welding, and/or through the use of a locking mechanism.

Figure 3B:
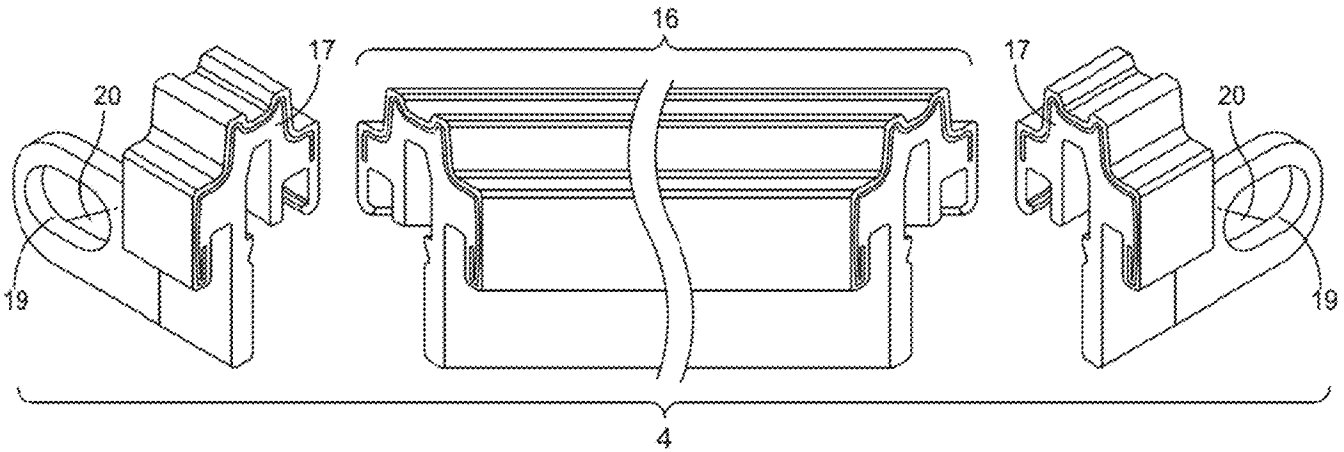
FIG. 3B is a perspective view of an example of a rear frame member with portions being shown in cross section.

Each end of rear bar portion 16 may be connected to a rear end joint 17. As shown in FIG. 3B, rear end joint 17 may be attached, at its proximal end, to the ends of rear bar portion 16 using any suitable techniques for attachment known to one of ordinary skill in the art, including gluing, stitching, fastening, screwing, welding, and/or a locking mechanism. At its proximal end, rear end joint 17 may have a cross-sectional shape that matches that of rear bar portion 16, including a vertical lip for attaching to rear hard shell 2, and a horizontal portion for matingly coupling to the bottom side of the horizontal portion of corresponding front frame member 3. At its distal end, rear end joint 17 may be designed and configured for coupling with rear corner member 6. Rear end joint 17 may be attached to rear corner member 6 using any suitable means for attachment as are known to those of ordinary skill in the art, including gluing, stitching, fastening, screwing, welding, and/or through the use of a locking mechanism. In a preferred example, the distal end of rear end joint 17 includes one or more openings 19 along its vertical lip portion through which a screw or bolt, or other fastener may be passed for attaching rear end joint 17 to rear corner member 6. The distal end of rear end joint 17 may also include one or more projections 20 for guiding rear end joint 17 into the proper alignment with rear corner member 6 and/or rear internal corner member 21 (See FIG. 2), as discussed below.

Referring again to FIG. 2, each end of rear corner member 6 may connect to two rear frame members 4 to achieve a 90-degree angle between two rear frame members 4. Rear corner member 6 may be formed of any suitable materials as are known to those of ordinary skill in the art, including wood, metal, or hard plastic, such as PVC or Acrylonitrile Butadiene Styrene (ABS) plastic. Rear corner member 6 may take any suitable shape, so long as it is capable of forming a right angle with two rear frame members 4. In a preferred example, rear corner member 6 is substantially rounded in order to avoid any potentially sharp edges and to provide an aesthetically pleasing appearance. As previously described, rear corner member 6 may be attached to rear end joint 17 using any suitable means for attachment as are known to those of ordinary skill in the art. However, in a preferred example, rear corner member 6 includes two projections 22 for extending through one or more openings 19 in rear end joint 17 as shown, for example, in FIGS. 5A and 5B. Projections 22 may also include one or more openings 23 for receiving a screw or bolt, or other fastener.

Figure 5B:
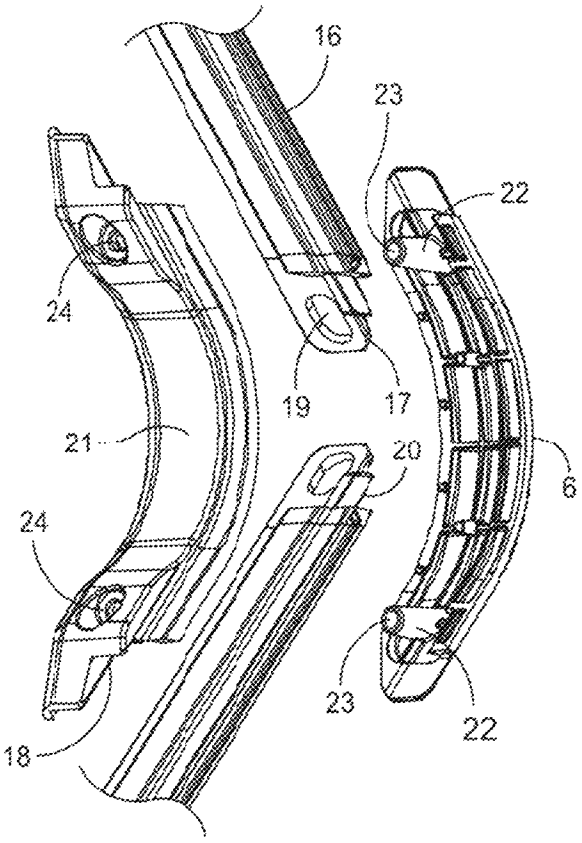
FIG. 5B is an internal perspective view of an intersection between a rear corner member, a rear internal corner member, and a rear frame member of an example of a modular suitcase.
Figure 5A:
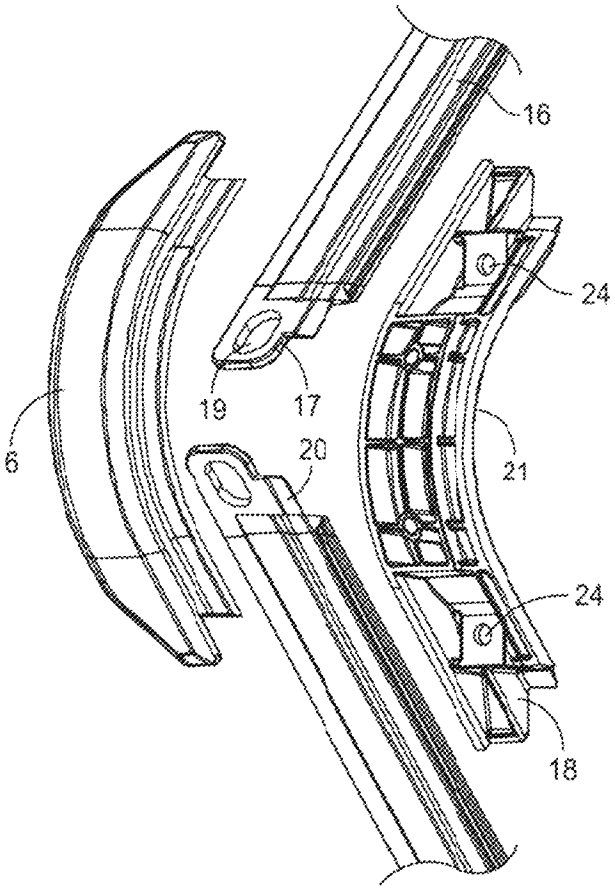
FIG. 5A is an external perspective view of an intersection between a rear corner member, a rear internal corner member, and a rear frame member of an example of modular suitcase.

FIGS. 5A and 5B show an exploded view of the rear corner member 6, the rear internal corner member 21, and the rear frame member 14 from external (FIG. 5A) and internal (FIG. 5B) perspectives. In some examples, rear corner member 6 and rear end joints 17 are also connected to a rear internal corner member 21 for additional stability. Rear internal corner member 21 may be constructed of the same materials as rear corner member 6, and may be generally shaped to matingly couple to rear corner member 6 while substantially enclosing rear end joints 17 and, in some examples, a portion of rear frame member 4. Rear internal corner member 21 may be attached to rear end joint 17 and rear corner member 6 using any suitable means for attachment as are known to those of ordinary skill in the art. However, in a preferred example, rear internal corner member 21 includes two openings 24 for receiving a screw or bolt, or other fastener, which may pass through opening 19 in rear end joint 17 and screw into opening 23 in rear corner member 6. As shown in FIG. 2, one or more of rear corner member 6 and/or rear internal corner member 21 may include one or more recessed portions 18 for receiving projections 21 for guiding rear end joint 17 into the proper alignment with rear corner member 6 and/or rear internal corner member 21.

Figure 6:
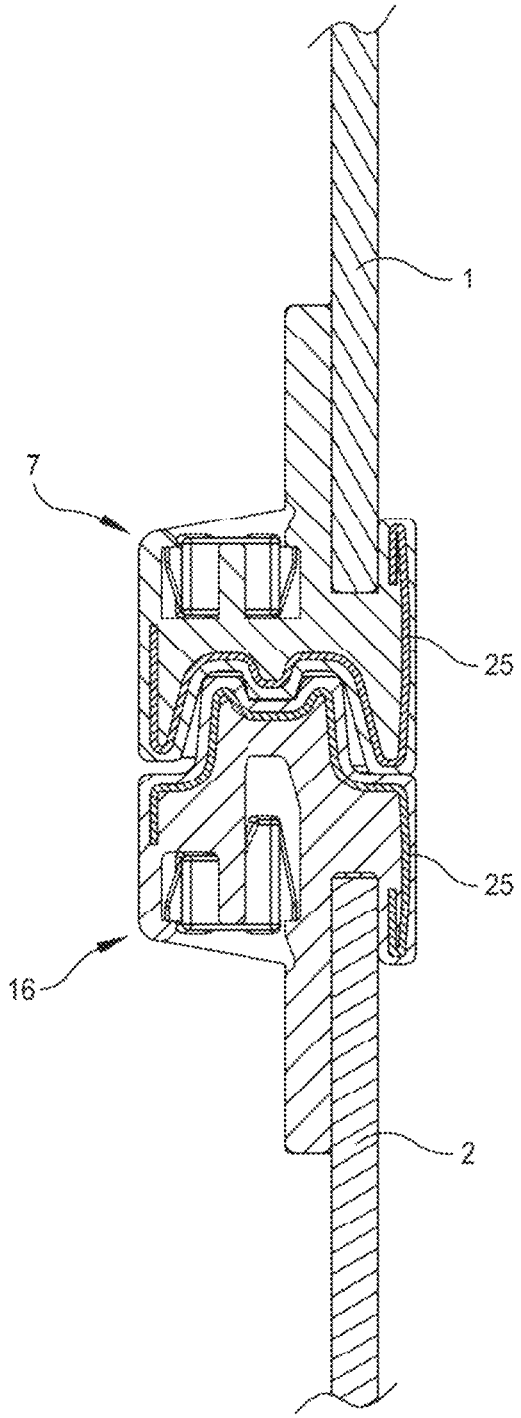
FIG. 6 is a cross-sectional view of a joint between two sides of an example of a modular suitcase.

FIG. 6 is a cross-sectional view of front frame member 3 and rear frame member 4 when a suitcase is in the closed position. More specifically, this view shows a cross section of front bar portion 7 and rear bar portion 16 in one example of the present disclosure. As shown, for example, in FIG. 6, the lip portions of front bar portion 7 and rear bar portion 16 are attached to the interior wall along the open edge of front hard shell 1 and rear hard shell 2, respectively. Furthermore, the open edges of front hard shell 1 and rear hard shell 2 may abut the horizontal portions of front bar portion 7 and rear bar portion 16. Front bar portion 7 and rear bar portion 16 may also be shaped so as to allow front frame member 3 and rear frame member 4 to matingly couple when the suitcase is in the closed position. For example, as shown in FIG. 6, the lower surface of the horizontal portion of front bar portion 7 may be concave and include a generally M-shaped surface whereas the top surface of the horizontal portion of rear bar portion 16 may be convex and include a substantially similar M-shaped surface. Thus, the bottom surface of the horizontal portion of front frame member 3 and top surface of the horizontal portion of rear frame member 4 are shaped so as to matingly couple when a piece of hard shell is in the closed position.

Both front bar portion 7 and rear bar portion 16 may be formed using any suitable means known to those of ordinary skill in the art for forming stiffened plastic components, including injection molding or an extrusion process. In one example, front bar portion 7 and rear bar portion 16 may be formed using an extrusion process. As shown in FIG. 6, for example, both front bar portion 7 and rear bar portion 16 may include a length of metal reinforcement 25 at the interior of the frame member. Metal reinforcement 25 may include a thin length of metal which may be folded or, itself, extruded into the shape of the desired frame member. For example, metal reinforcement 25 may be folded or, itself, extruded into an M-shaped cross section along its length, as shown, for example, in FIG. 6. Once metal reinforcement 25 is formed into a desired shape, it may be passed through a plastic extruder and thereby embedded within a length of front bar portion 7 or rear bar portion 16. The extrusion die should be configured to create a suitable cross-sectional shape for front bar portion 7 and rear bar portion 16 such that they may matingly couple when a hard shell luggage item is in the closed position, as described above. In some examples, the extruder may be configured to employ a dual durometer extrusion, whereby the lip portion of front bar portion 7 and rear bar portion 16 may be extruded with a soft plastic material suitable for stitching and/or gluing the front bar portion 7 and the rear bar portion 16 to front hard shell 1 and rear hard shell 2. Front bar portion 7 and rear bar portion 16 may otherwise be formed of any suitable hard plastic material known to one of ordinary skill in the art, including PVC or ABS plastic.

In other examples, front bar portion 7 and rear bar portion 16 may be formed to desired sizes through an injection molding process, without the need to cut extruded lengths of front bar portion 7 and rear bar portion 8. In some examples, a dual durometer injection molding process may be employed, whereby the lip portion of front bar portion 7 and rear bar portion 16 may be formed with a soft plastic material suitable for stitching and/or gluing the front bar portion 7 and the rear bar portion 16 to front hard shell 1 and rear hard shell 2. Front bar portion 7 and rear bar portion 16 may otherwise be formed of any suitable hard plastic material known to one of ordinary skill in the art, including PVC or ABS plastic. In some examples, a metal reinforcement strip may also screwed or clipped to Front bar portion 7 and/or rear bar portion 16 for additional strength. In other examples, spaced ribs may be employed on front bar portion 7 and/or rear bar portion 16 using metal or hard plastic ribs. The ribs may be placed in a zig-zag fashion, in an "V" shape, or an "M" shape, or in the form of a truss along the length of front bar portion 7 and rear bar portion 16. In some examples, the suitcase is so short that additional reinforcements may not be necessary and front bar portion 7 and rear bar portion 16 may be cut or formed to a desired length without additional reinforcements.

By utilizing a few modular components that are readily mass produced, the suitcase of the present disclosure utilizes an efficient and cost-effective manufacturing process. For example, a suitcase according to the present disclosure may be manufactured by forming a plurality of hard shells, according to one or more of the processes described above for forming hard shells for luggage. The plurality of hard shells may include at least a front hard shell 1 and a rear hard shell 2 which, in some examples, may be identical or substantially identical. In a preferred example, front hard shell 1 and rear hard shell 2 have identical or substantially identical widths and lengths. A length of front bar portion 7 and a separate length rear bar portion 16 may also be formed by any of the processes described above. At least four sections of front bar portion 7 and four sections of rear bar portion 16 may then be cut, if necessary, to provide the necessary framing material. At least two sections of front bar portion 7 and rear bar portion 16 may be provided corresponding to the width of the hard shells. At least two sections of front bar portion 7 and rear bar portion 16 may be provided corresponding to the height of the hard shells. Eight or more of front end joint 8 and rear end joint 17 may also be formed. Eight or more of front corner member 5, rear corner member 6, front internal corner member 12, and rear internal corner member 21 may also be formed and provided.

Using the above enumerated modular components, a suitcase frame may be formed by joining the eight front end joints 8 to the ends of the four sections of front bar portion 7, thereby forming four front frame members 3. The eight rear end joints 17 may also be joined to the ends of the four sections of rear bar portion 16, thereby forming four rear frame members 4. A front frame may then be constructed by attaching a first front frame member 3 to a first front corner member 5, attaching a second front frame member 3 to the first front corner member 5, and attaching a first front internal corner member 12 to the first front corner member 5, as described above, so as to form a right angle between the first and second front frame members 3. In a preferred example each front frame members 3 is attached to a front corner member 5 and a front internal corner member by inserting projections 14 on the front corner member 5 through openings 10 in the front end joint 8 and through openings 15 in the front internal corner member 12. A screw, bolt, or other fastener may then attach the front frame member 3 to the front corner member 5 and the front internal corner member 12.

In a similar manner, the second front frame member 3 may be connected to a second front corner member 5, a second front internal corner member 12, and a third front frame members 3, so as to form a second right angle between the second and third front frame members 3. Likewise, the third front frame member 3 may be connected to a third front corner member 5, a third front internal corner member 12, and a fourth front frame members 3, so as to form a third right angle between the third and fourth front frame members 3. Finally, the fourth front frame member 3 may be connected to a fourth front corner member 5, a fourth front internal corner member 12, and the first front frame members 3, so as to form a fourth right angle between the fourth and first front frame members 3.

The rear frame may also be constructed by joining each rear end joint 17 to the end of its respective rear bar portion 16, thereby forming four rear frame members 4. The four rear frame members 4 may be further formed into a rear frame by joining the four rear frame members 4 with four rear corner members 6 and four rear internal corner members 21, in the manner described above with respect to the front frame.

Once constructed, the front frame may be fastened to the front hard shell 1 and the rear frame may be fasted to the rear hard shell 2 using any suitable means as are known to those of ordinary skill in the art, including gluing, stitching, welding, screwing, crimping, and/or a locking mechanism. In a preferred example, the lip portions of front frame member 3 and rear frame member 4 are attached to the interior wall along the open edge of front hard shell 1 and rear hard shell 2, respectively, as shown for example in FIG. 6, by gluing and stitching them together. In this exemplary configuration, the lip portions of front frame member 3 and rear frame member 4 may be glued and/or stitched to the interior wall along the open edge of front hard shell 1 and rear hard shell 2.

As shown, for example, in FIGS. 10A-10E, the modular frame of the present disclosure is not limited to use with hard shell luggage and, in some examples, a modular frame may be installed on soft-sided luggage in a similar manner to how it may be installed on hard-sided luggage. On soft-sided luggage, a modular frame according to the present disclosure may remove the need for a zippered opening and provide for a more secure locking mechanism.

Installing a modular frame according to the present disclosure on a piece of soft-sided luggage may be accomplished in a manner similar to installation on a piece of hard luggage. Once constructed with the appropriate dimensions, a front frame may be fastened to the front side 43 of a piece of soft-sided luggage, and the rear frame may be fasted to the rear side 45 using any suitable means of attachment as are known to those of ordinary skill in the art, including gluing, stitching, welding, screwing, and/or a locking mechanism. In a preferred example, the lip portions of front frame member 3 and rear frame member 4 are attached to the interior wall along the open edge of front side 43 and rear side 45, respectively, as shown for example in FIG. 10D by gluing and stitching them together. In this exemplary configuration, the lip portions of front frame member 3 and rear frame member 4 may be glued and/or stitched to the interior wall along the open edge of front side 43 and rear side 45. The lip portions of front frame member 3 and rear frame member 4 may be attached directly to the soft outer material of the soft-sided luggage, which may be cloth, canvas, ballistic nylon, or any other suitable materials for the outer surface of soft-sided luggage as are known to one of ordinary skill in the art. When additional structural support or a stronger connection is desired, the lip portions of front frame member 3 and rear frame member 4 may also be attached to a supporting material which may be disposed below the outer material of a soft-sided bag, such as cardboard, wood, or polypropylene board.

By attaching a modular frame of the present disclosure to a soft-sided luggage, a piece of luggage may be provided for that is more resistant to tampering and theft. For example, the inclusion of a modular, rigid frame on a soft-sided item of luggage may allow designers to avoid using a zippered closure as the primary opening means for a suitcase. Zippered closures may be viewed as less secure because they are more prone to ripping or cutting in the event of an attempted theft of items retained within a suitcase. A rigid frame, on the other hand, is less susceptible to cutting and/or ripping. A rigid, modular frame also allows for the provision of stronger locking mechanisms, as described below with respect to FIGS. 8 and 9, which may further secure soft-sided luggage which often times is only secured by one or more zipper pull locks, which may be less secure.

Figure 7A:
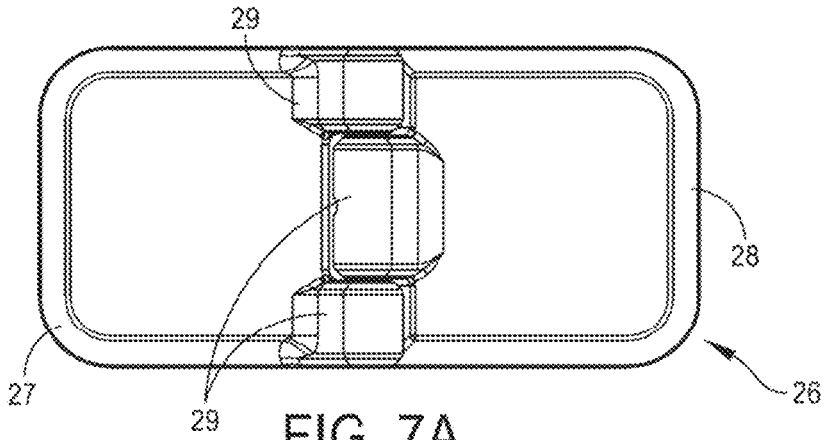
FIG. 7A is a top plan view of a hinge of one example of the present disclosure.
Figure 7B:
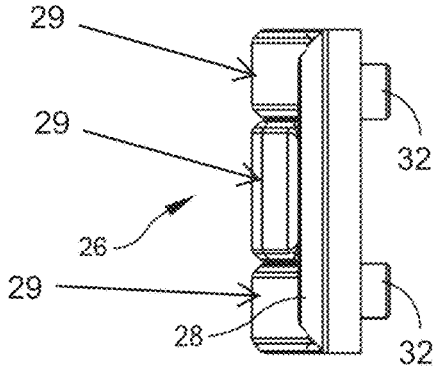
FIG. 7B is a front view of a hinge of an example of the present disclosure.
Figure 7C:
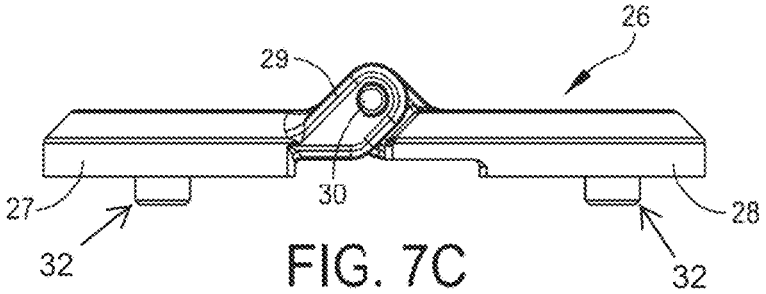
FIG. 7C is a side view of a hinge of an example of the present disclosure.
Figure 7D:
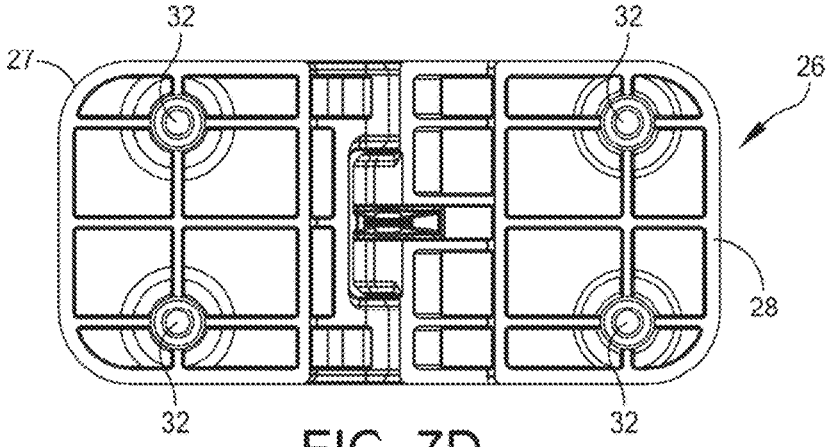
FIG. 7D is bottom view a hinge of an example of the present disclosure.
Figure 7E:
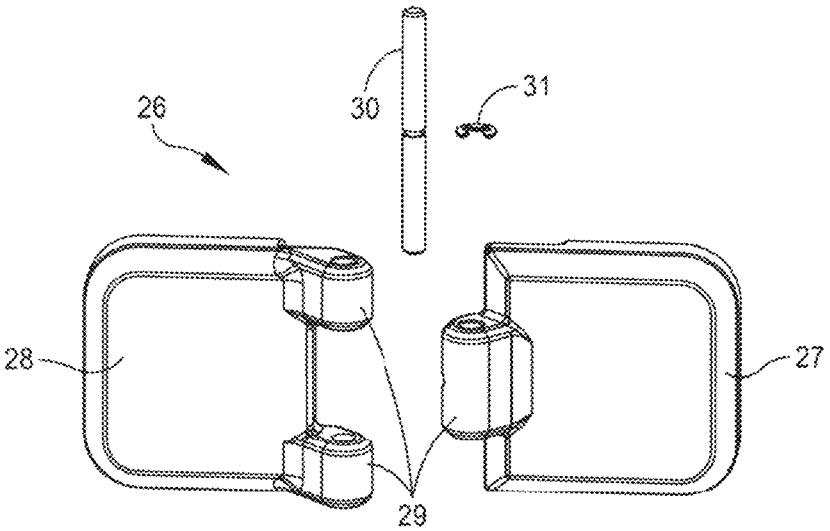
FIG. 7E is an exploded perspective view of a hinge of an example of the present disclosure.
Figure 7F:
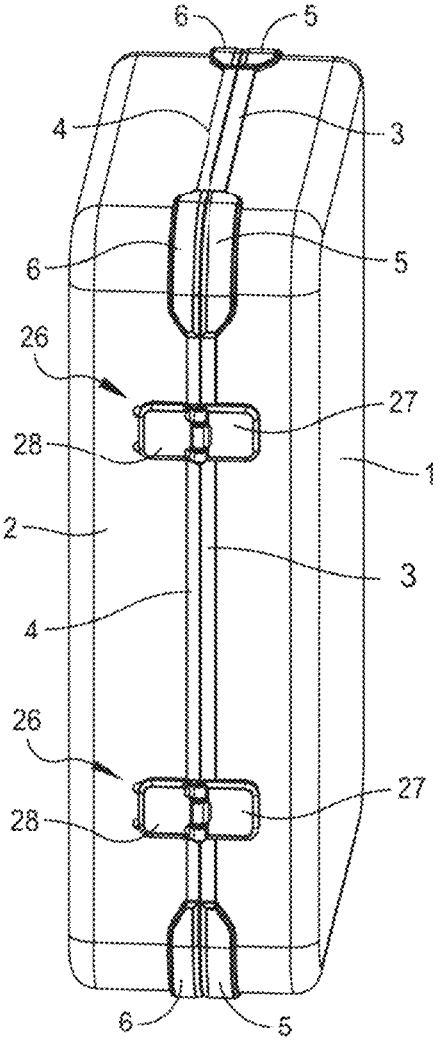
FIG. 7F is a perspective view of an example of a modular suitcase having multiple hinges provided thereon.

With the front frame attached to front hard shell 1 and the rear frame attached to rear hard shell 2, front hard shell 1 and rear hard shell 2 may join along their open faces, whereby the front frame will matingly couple, enclosing an empty space defined by the interior of front hard shell 1 and rear hard shell 2. Additional luggage hardware components may then be added to the suitcase. For example, one or more hinges 26 may be added to the seam between front hard shell 1 and rear hard shell 2, as show for example in FIGS. 7A-7F. FIGS. 7A-7C show a top, end, and side view of an exemplary hinge according to one example of the disclosure. As shown, for example, in FIG. 7D, hinge 26 may include a front leaf 27 and a rear leaf 28. Both front leaf 27 and rear leaf 28 may include a one or more cylindrical projections 29 for receiving a pin 30 (see FIG. 7E). Pin 30 pay pass through cylindrical projections 29 thereby connecting front leaf 27 to rear leaf 28 and thereby allowing front leaf 27 and rear leaf 28 to swing relative to one another. An o-ring 31 (see FIG. 7E) may also be fit onto a recessed portion of pin 30 to retain pin 30 within the one or more hollow projections 29 without slipping out.

One or more of hinge 26 may be attached to a suitcase using any suitable means for fastening, including gluing, welding, stitching, fastening, or a locking mechanism. In a preferred example, hinge 26 may be attached by passing a screw or other suitable fastener through an interior sidewall of front hard shell 1 and/or rear hard shell 2 and screwing into one or more hollow feet 32 on the underside of hinge 26, as shown for example in FIG. 7D. As shown, for example, in FIG. 7E, front leaf 27 may be attached to front hard shell 1 and rear leaf 28 may be attached to rear hard shell 2, thereby allowing front hard shell 1 and rear hard shell 2 to swing open and closed relative to one another.

Figure 8A:
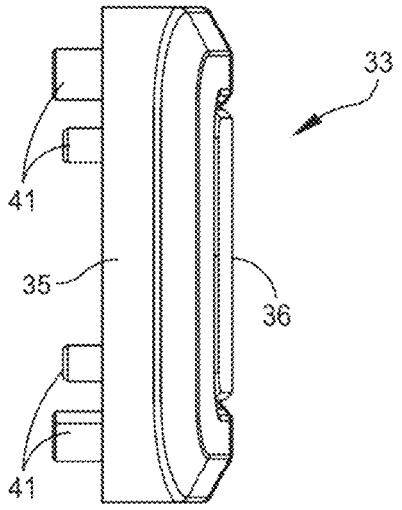
FIG. 8A is an end view of an example of a latch of a modular suitcase.
Figure 8B:
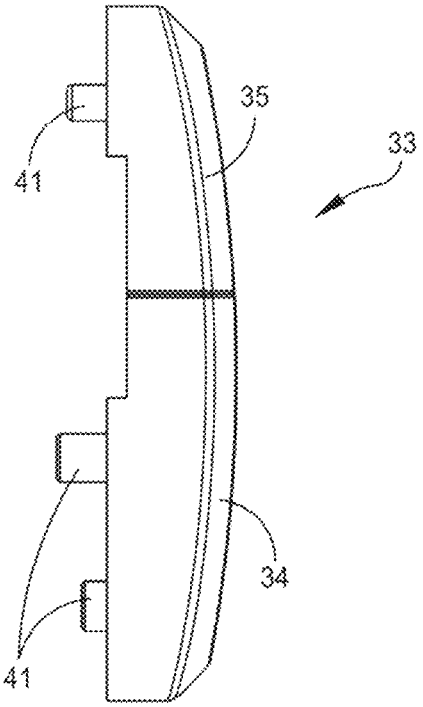
FIG. 8B is a side view of the latch.
Figure 8C:
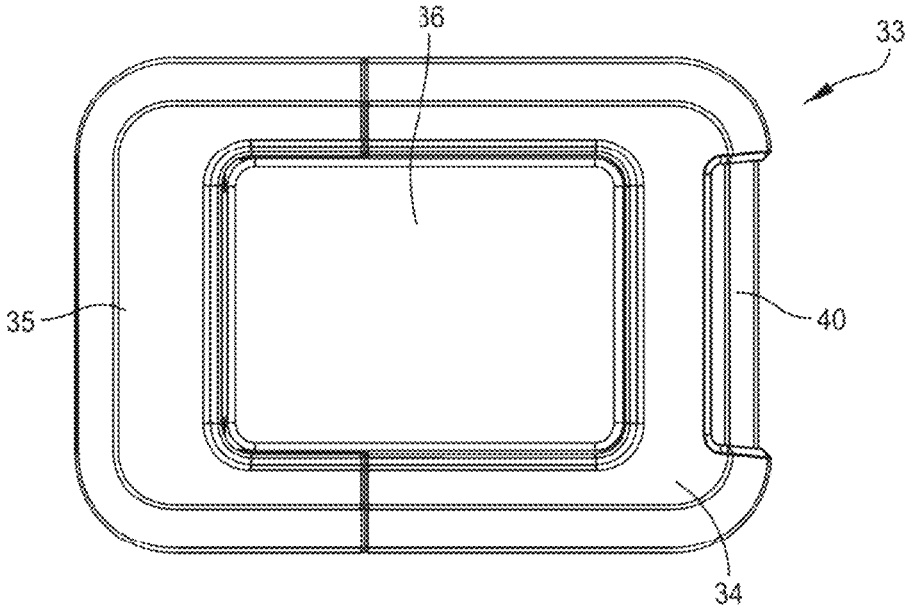
FIG. 8C is a top plan view of the latch.
Figure 8D:
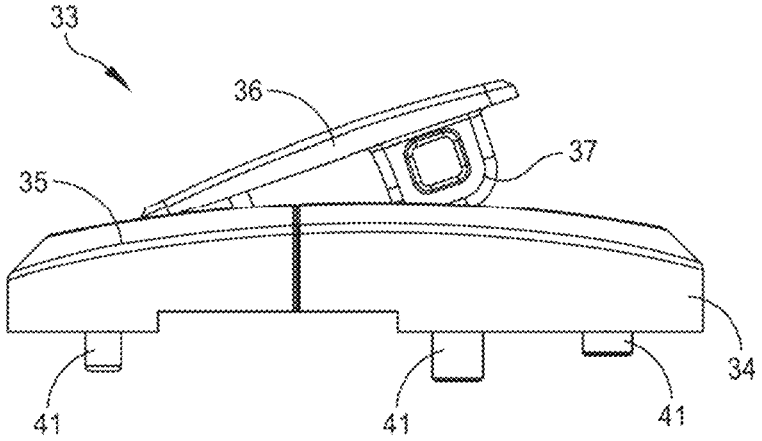
FIG. 8D is a side view of the latch in an open position.
Figure 8E:
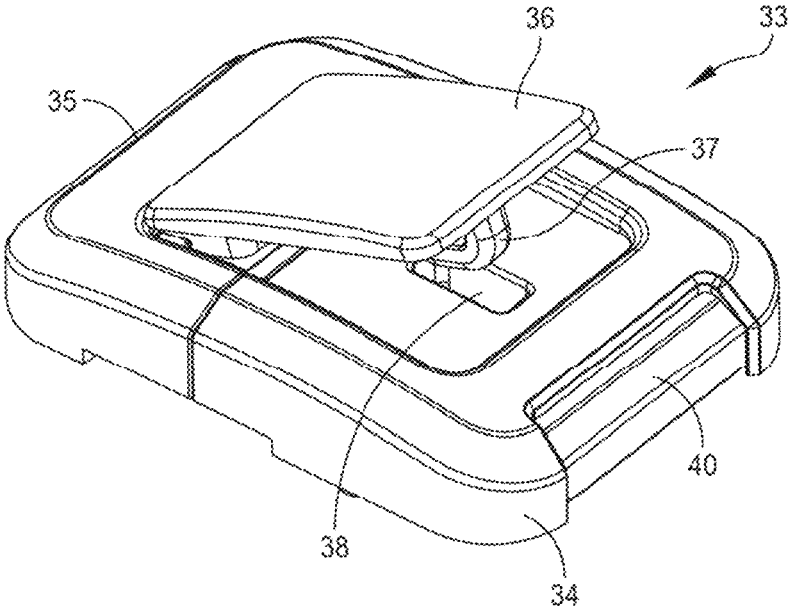
FIG. 8E is a perspective view of the latch in an open position.
Figure 9A:
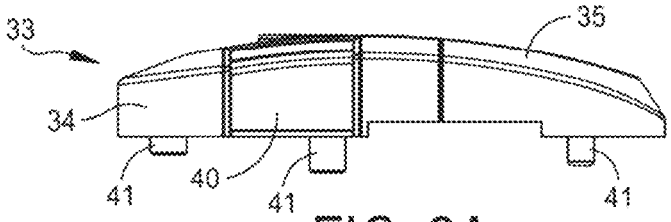
FIG. 9A is a side view of an example of a lock of a modular suitcase.
Figure 9B:
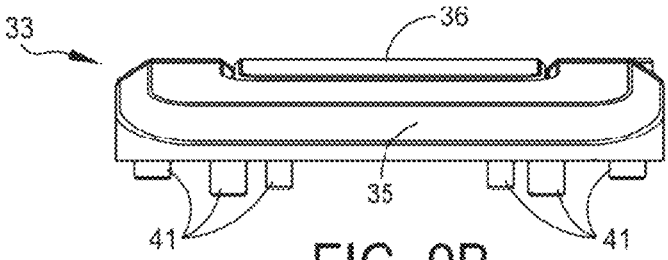
FIG. 9B is an end view of the lock.
Figure 9C:
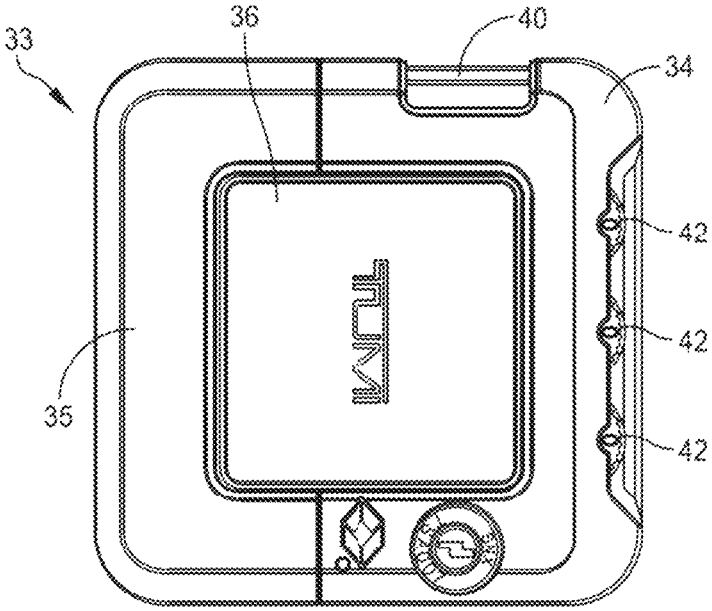
FIG. 9C is a plan view of the lock.
Figure 9D:
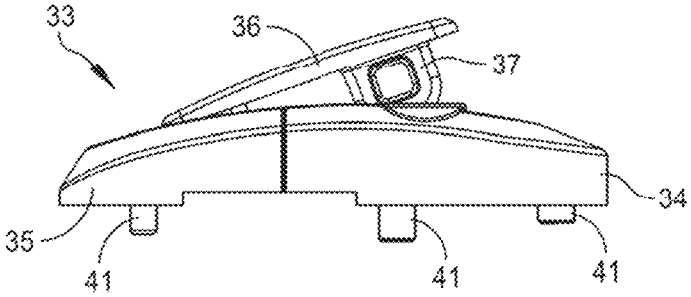
FIG. 9D is a side view of the lock in an open position.
Figure 9E:
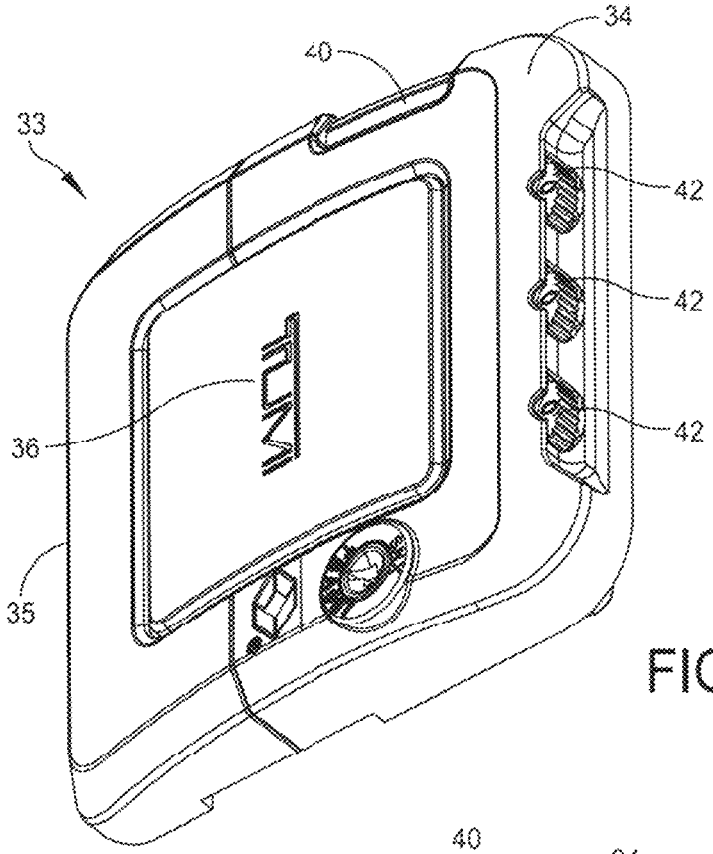
FIG. 9E is a perspective view of the lock.
Figure 9F:
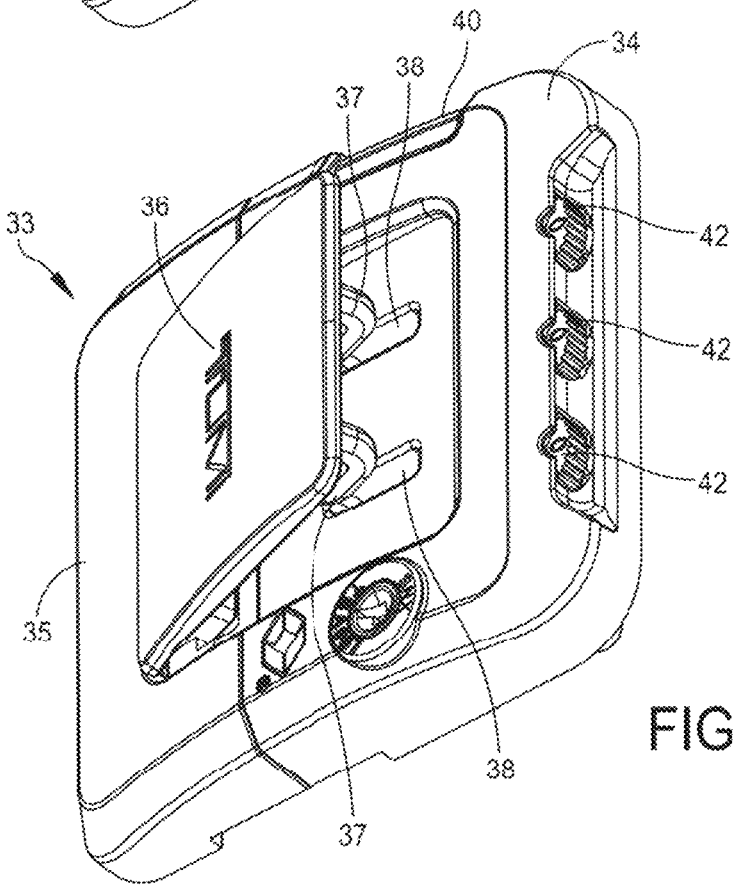
FIG. 9F is a perspective view of the lock in an open position.
Figure 10A:
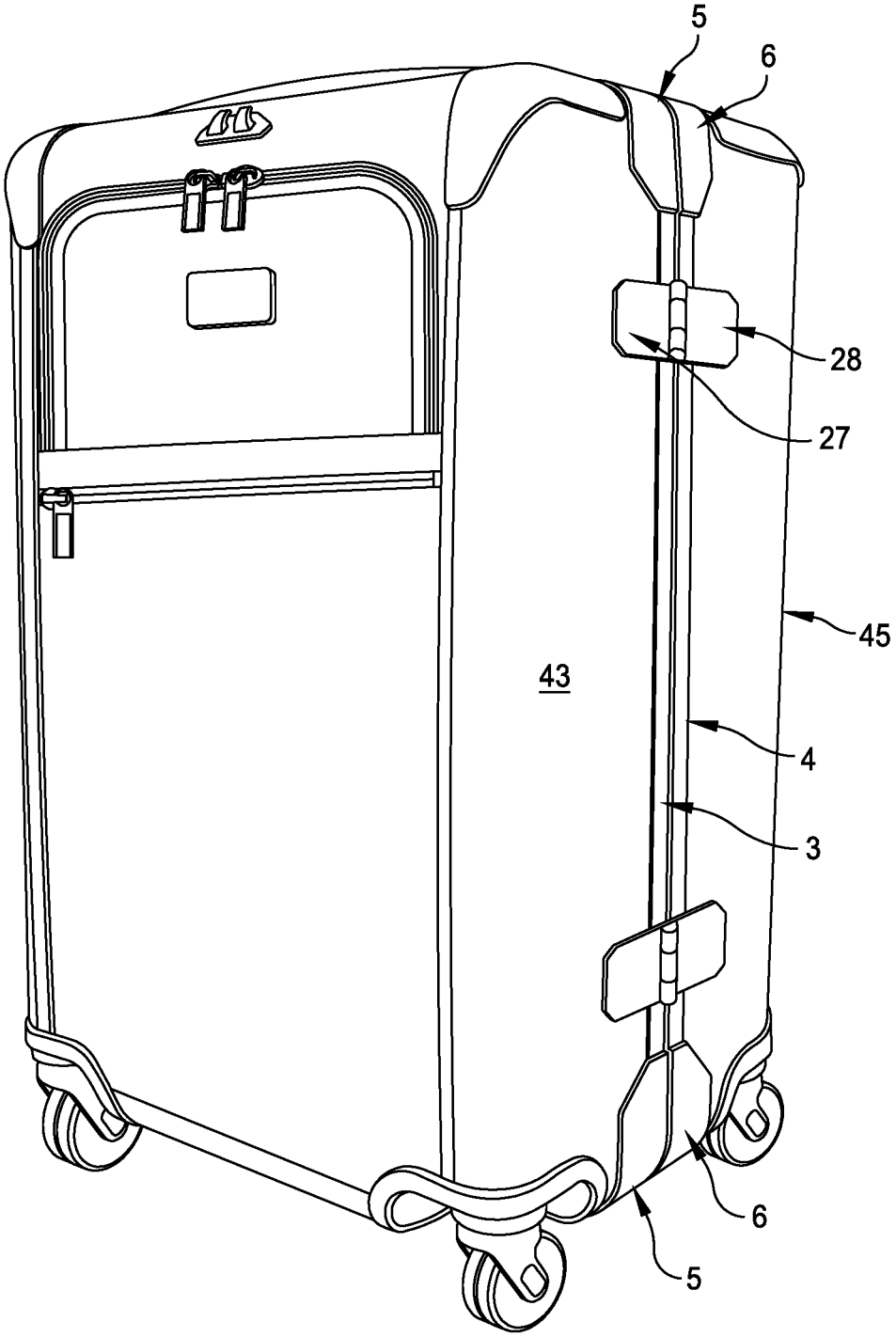
FIG. 10A is a side view of a soft sided suitcase with a modular frame according to one example of the present disclosure.
Figure 10B:
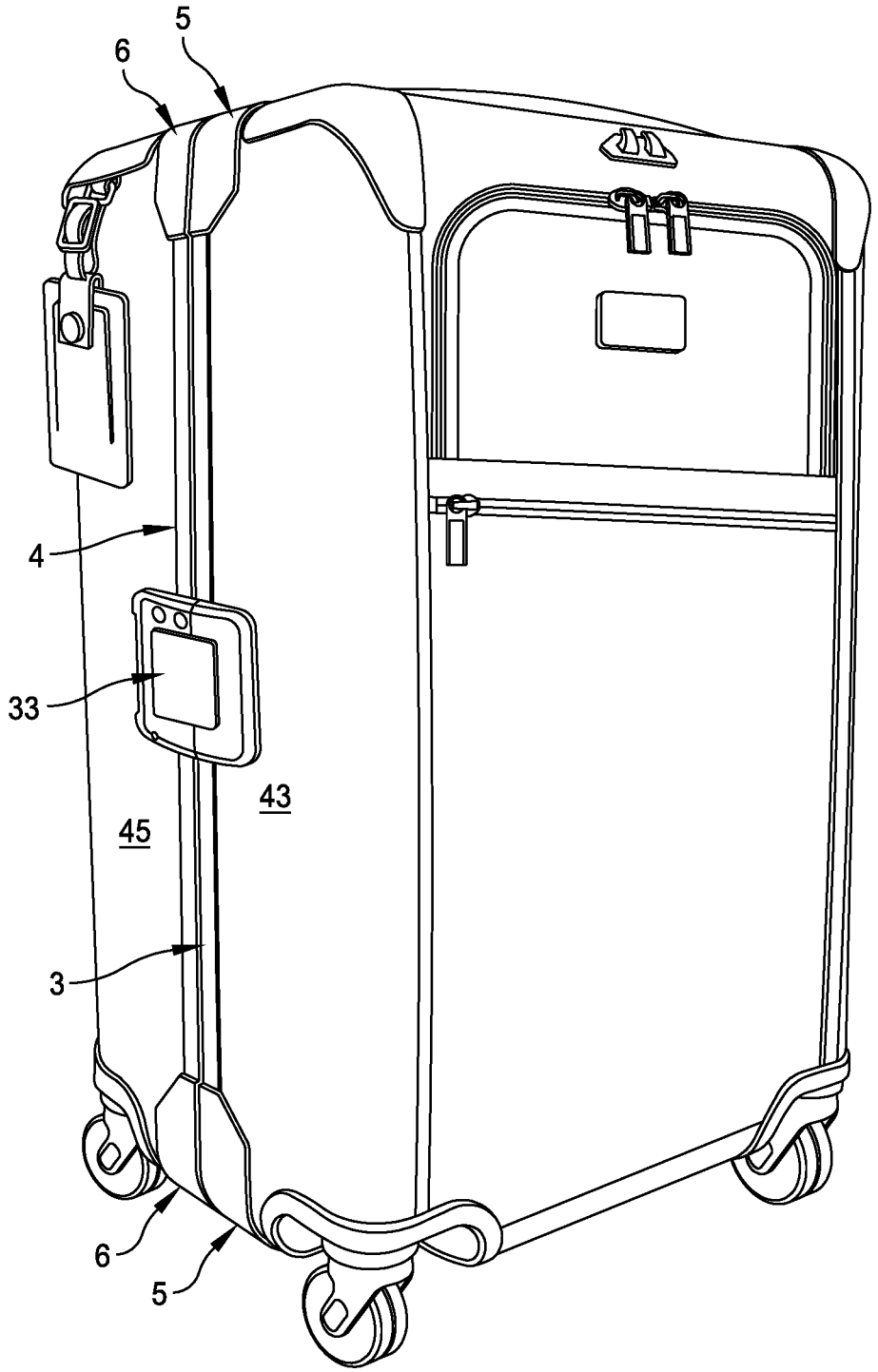
FIG. 10B is a perspective view of the soft sided suitcase.
Figure 10C:
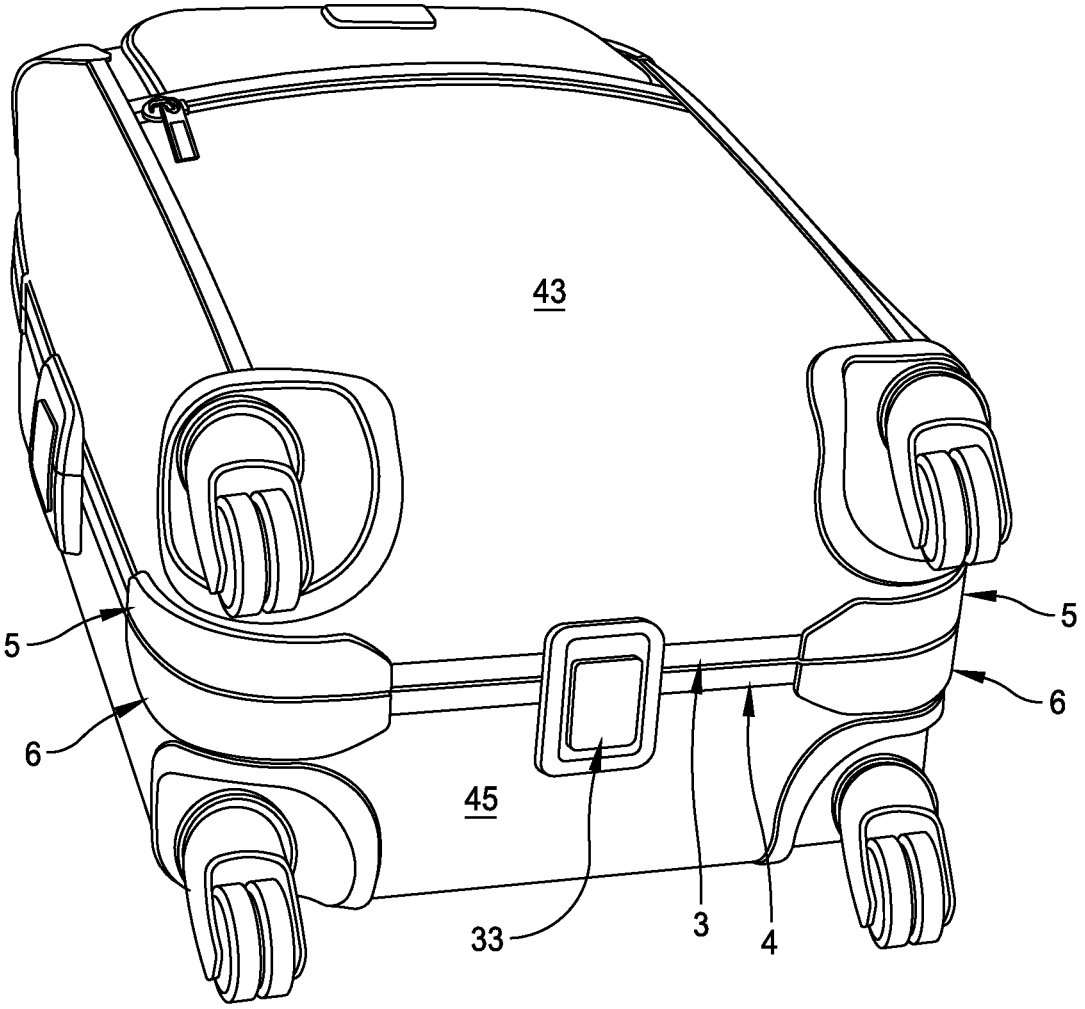
FIG. 10C is a bottom view of the soft sided suitcase.
Figure 10D:
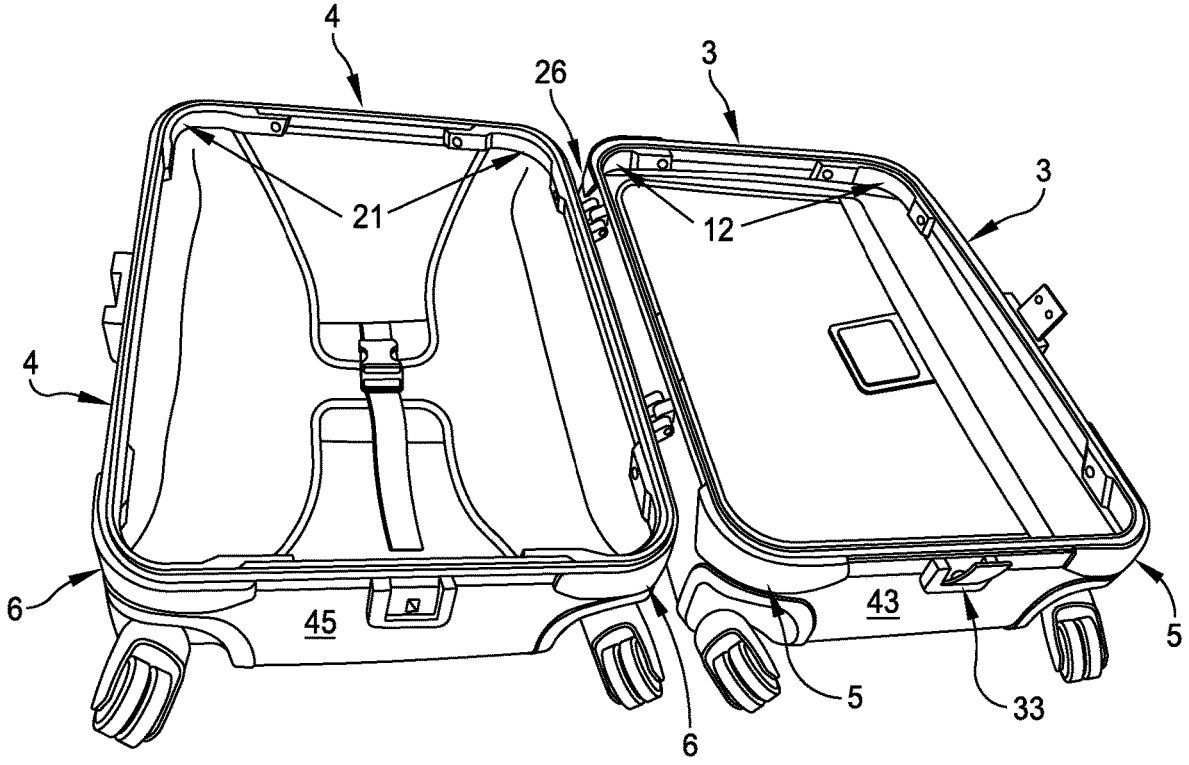
FIG. 10D is an interior view of the soft sided suitcase in an open position.
Figure 10E:
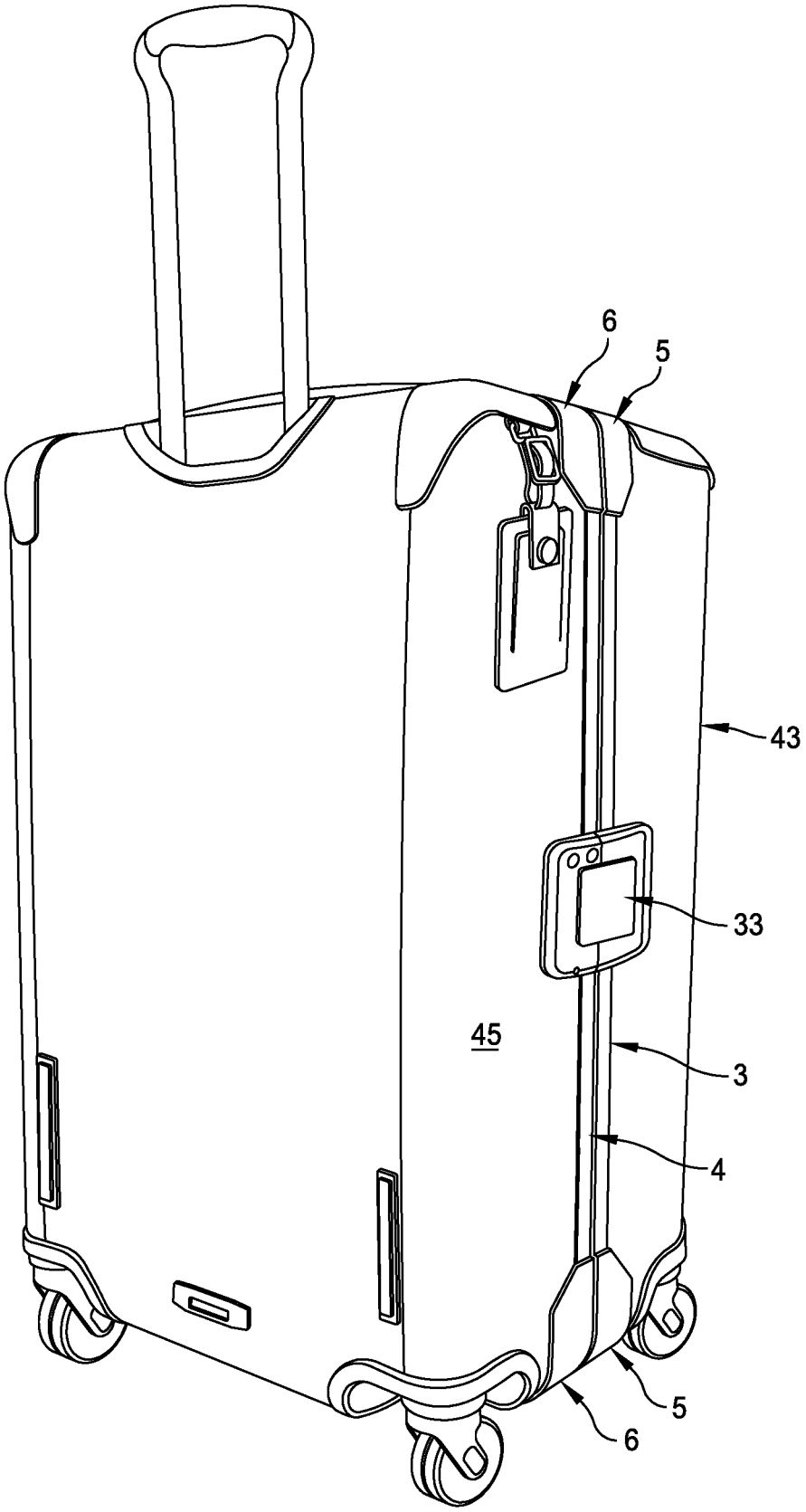
FIG. 10E is a rear view of the soft sided suitcase.

Examples of the present disclosure may also include a latch 33, as shown for example in FIGS. 8A-8E. FIGS. 8A-8C show end, side, and top views of latch 33, as may be used in an example of the disclosure. As shown in FIGS. 8D and 8E, latch 33 may include a catch portion 34 and a lever portion 35. In some examples, the catch portion 34 may be attached to rear hard shell 2 and the lever portion 35 may be attached to front hard shell 1. In some examples, lever portion 35 may include a spring-loaded hinged arm 36 that is persistently biased in the open position. A portion of the spring-loaded hinged arm 36 may have one or more eyelets 37 for locking the spring-loaded hinged arm 36 in a closed position. The catch portion 34 may have one or more recessed slots 38 for receiving the eyelets 37 and a spring-loaded lock, or other suitable locking mechanism known to one of ordinary skill in the art, that is disposed within the one or more recessed slots 38 and may releasably engage with eyelet 37 when the latch is in the closed position. Catch portion 34 may further include a button 40 for releasing the lock, thereby disengaging lever portion 35, allowing it to swing into an open position.

One or more of latch 33 may be attached to a suitcase using any suitable means for fastening, including gluing, welding, stitching, fastening, or a locking mechanism. In a preferred example, latch 33 may be attached by passing a screw or other suitable fastener through an interior sidewall of front hard shell 1 and/or rear hard shell 2 and screwing into one or more feet 41 on the underside of latch 33, as shown for example in FIGS. 8A, 8B, and 8D. In a preferred example, catch portion 34 may be attached to rear hard shell 2 and a lever portion 35 may be attached to front hard shell 1, thereby allowing latch 33 to hold front hard shell 1 in a closed position against rear hard shell 2.

FIGS. 9A-9F shows an alternative example of a latch that further includes a combination lock, with each wheel of the combination lock being indicated at 42. In this example, latch 33 may include two eyelets 37 and two corresponding slots 38 for receiving and locking with the eyelets 37. Furthermore, in this example, button 40 and/or an internal lock may be further held in place through the use of a combination lock 42. Combination lock wheels 42 may use any suitable techniques for locking button 40 and/or an internal lock, as are known to those of ordinary skill in the art. In one example, the combination lock includes a series of numbered locking wheels 42 which may include a series of internal protrusions (not shown), that preclude button 39 from being depressed and/or lock 40 from being released, unless the series of internal protrusions are properly aligned, using the correct series of numbers.

As most travel luggage being marketed currently is of the towable, wheeled type, in practice for such luggage items, the bottom portion of front hard shell 1 and/or rear hard shell 2, or any other suitable portion of the luggage, can be configured to accept wheels. For example, a portion of front hard shell 1 and/or rear hard shell 2, or any other suitable portion of the luggage, may include an engagement feature to engage a wheel, using techniques that are familiar to one of ordinary skill in the art. The engagement feature can be a socket, bore, hole, or other suitable mechanism for engaging a wheel assembly. Additionally, in any configuration, the wheels can be swivel wheels or can be fixed wheels, or can be any other suitable type of wheel for wheeled luggage. Furthermore, any suitable surfaces of front hard shell 1 and/or rear hard shell 2, or any other suitable portion of the luggage, can be configured to accept a carrying handle, a retractable handle, or other suitable carrying hardware as is known to one of ordinary skill in the art.

Thus, the modular suitcase of the present disclosure may be constructed using a novel and efficient method for manufacturing luggage of varying designs and dimensions. Examples of the present disclosure may be constructed using modular components that may be readily mass produced, easily adapted to luggage of varying sizes, and quickly assembled from just a few simple components. Thus the present disclosure provides a more efficient method for manufacturing luggage as well as an article of luggage that may be easily repaired using the same, mass-produced parts. Furthermore, the components of the present disclosure may also be easily adapted for use with suitcases of varying sizes and dimensions. For example, the suitcase components described with respect to the disclosed examples would be suitable for a wide range of suitcase sizes and dimensions, simply by cutting a mass-produced stock of front bar portion 6 and rear bar portion 17 to the lengths required for any given piece of luggage. All other modular components described herein, aside from front hard shell 1, and rear hard shell 2, may be used with a hard shell luggage of virtually any size or dimensions, without the need for manufacturing unique hardware components for separate hard shell luggage designs.

While the disclosed subject matter is described herein in terms of certain examples, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other examples having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A piece of luggage comprising:

a front shell;

a rear shell;

a frame assembly including a front frame sub-assembly configured to be secured to the front shell and a rear frame sub-assembly configured to be secured to the rear shell, each of the front frame sub-assembly and the rear frame sub-assembly including a plurality of frame members and a plurality of corner members configured to be interchangeably assembled to achieve a respective frame sub-assembly; and at least one hinge that joins the front shell to the rear shell, wherein the plurality of corner members includes at least one front corner member and at least one rear corner member, wherein the plurality of corner members further includes at least one front internal corner member and at least one rear internal corner member, wherein each front corner member includes a projection configured to extend through an opening in a respective front joint member connected to one of the frame members of the front frame sub-assembly, and each front internal corner member has an opening configured to receive a fastener so that the respective fastener extends through the opening of the front internal corner member and into the projection of the front corner member, and wherein each rear corner member includes a projection configured to extend through an opening in a respective rear joint member connected to one of the frame members of the rear frame sub-assembly, and each rear internal corner member has an opening configured to receive a fastener so that the respective fastener extends through the opening of the rear internal corner member and into the projection of the rear corner member.

2. The piece of luggage of claim 1, wherein the piece of luggage comprises a piece of hard shell luggage and said front shell and said rear shell comprise hard shells.

3. The piece of luggage of claim 1, wherein the front shell and the rear shell are soft-sided shells.

4. The piece of luggage of claim 2, wherein the plurality of frame members includes at least one front edge frame member and at least one rear edge frame member.

5. The piece of luggage of claim 4, wherein the at least one front edge frame member has a front edge coupling portion that extends along a length of the front edge frame member and the at least one of a rear edge frame member has a rear edge coupling portion that extends along a length of the rear edge frame member, the front edge coupling portion and the rear edge coupling portion being configured to mate with one another.

6. The piece of luggage of claim 4, wherein the at least one front edge frame member includes a front tab portion configured to be secured to a respective front corner member and a respective front internal corner member.

7. The piece of luggage of claim 6, wherein the at least one rear edge frame member includes a rear tab portion configured to be secured to a respective rear corner member and a respective rear internal corner member.

8. The piece of luggage of claim 1, wherein the at least one hinge is attached to the front shell and to the rear shell.

9. The piece of luggage of claim 1, wherein the at least one hinge is attached to the front frame sub-assembly and the rear frame sub-assembly.

10. The piece of luggage of claim 1, further comprising:

at least one projection on each front joint member; and at least one recess on each front internal corner member for receiving a respective projection of the respective front joint member, and for guiding the respective front joint member into proper alignment with the respective front internal corner member.

11. A piece of luggage comprising:

a front shell and a rear shell, each shell comprising an internal compartment for receiving contents;

at least four pieces of front edge framing material having a tab portion and a front edge coupling portion that extends along the length of said front edge framing material;

at least four pieces of rear edge framing material having a tab portion and a rear edge coupling portion that extends along the length of the rear edge framing material, wherein said front edge coupling portion and said rear edge coupling portion are capable of matingly coupling;

at least sixteen corner pieces;

at least eight front edge joint pieces;

at least eight rear edge joint pieces;

a front edge frame comprising said at least four pieces of front edge framing material, at least eight front edge joint pieces, and at least four reinforcing corner pieces of said at least sixteen corner pieces;

a rear edge frame comprising said at least four pieces of rear edge framing material, at least eight rear edge joint pieces, and at least four reinforcing corner pieces of said at least sixteen corner pieces;

wherein said front edge frame is attached to said front shell and said rear edge frame is attached to said rear shell; and at least one hinge joining said front shell to said rear shell, wherein the at least sixteen corner pieces comprises at least four front external reinforcing corner pieces, at least four front internal reinforcing corner pieces, at least four rear external reinforcing corner pieces, and at least four rear internal reinforcing corner pieces, and wherein said at least four front external reinforcing corner pieces matingly couples with said at least four rear external reinforcing corner pieces and said at least four front internal reinforcing corner pieces matingly couples with said at least four rear internal reinforcing corner pieces, wherein each front external reinforcing corner piece includes a projection configured to extend through an opening in one of the front edge joint pieces connected to one of the pieces of front edge framing material, and each front internal reinforcing corner piece has an opening configured to receive a fastener so that the respective fastener extends through the opening of the front internal reinforcing corner piece and into the projection of the front external reinforcing corner piece, and wherein each rear external reinforcing corner piece includes a projection configured to extend through an opening in one of the rear edge joint pieces connected to one of the pieces of rear edge framing material, and each rear internal reinforcing corner piece has an opening configured to receive a fastener so that the respective fastener extends through the opening of the rear internal reinforcing corner piece and into the projection of the rear external reinforcing corner piece.

12. The piece of luggage of claim 11, wherein said front edge frame is attached to said front shell along said tab portion of said front edge framing material and said rear edge frame is attached to said rear shell along said tab portion of said rear edge framing material.

13. The piece of luggage of claim 11, further comprising a latch or a lock attached to one or more of said front or rear shells.

14. The piece of luggage of claim 11, wherein said front shell and said rear shell comprise hard shells.

15. The piece of luggage of claim 11, wherein said front shell and the rear shell are soft-sided shells.

16. The piece of luggage of claim 11, wherein the at least one hinge is attached to the front shell and to the rear shell.

17. The piece of luggage of claim 11, wherein the at least one hinge is attached to the front edge frame and the rear edge frame.

18. The piece of luggage of claim 11, wherein a lip on each piece of front edge framing material of said front edge frame is attached to an interior wall of said front shell, and wherein a lip on each piece of rear edge framing material of said rear edge frame is attached to an interior wall of said rear shell.

19. The piece of luggage of claim 11, wherein the at least four pieces of front edge framing material consist essentially of four pieces of front edge framing material;

wherein the at least four pieces of rear edge framing material consist essentially of four pieces of rear edge framing material;

wherein the at least sixteen corner pieces consist essentially of sixteen corner pieces;

wherein the at least eight front edge joint pieces consist essentially of eight front edge joint pieces;

wherein the at least eight rear edge joint pieces consist essentially of eight rear edge joint pieces;

wherein the sixteen corner pieces further consists of four front external reinforcing corner pieces, four front internal reinforcing corner pieces, four rear external reinforcing corner pieces, and four rear internal reinforcing corner pieces.

* * * * *